US010363570B2

(12) United States Patent
Natsume

(10) Patent No.: US 10,363,570 B2
(45) Date of Patent: Jul. 30, 2019

(54) PAINT BAKING METHOD AND DOOR OFFSET DEVICE FOR VEHICLE BODY COATING PROCESS

(71) Applicant: Nissan Motor Co., Ltd., Yokohama-shi, Kanagawa (JP)

(72) Inventor: Tomoyuki Natsume, Kanagawa (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/545,064

(22) PCT Filed: Jan. 26, 2015

(86) PCT No.: PCT/JP2015/051997

§ 371 (c)(1),
(2) Date: Jul. 20, 2017

(87) PCT Pub. No.: WO2016/120968

PCT Pub. Date: Aug. 4, 2016

(65) Prior Publication Data

US 2018/0008998 A1 Jan. 11, 2018

(51) Int. Cl.

| | |
|---|---|
| ***B05D 3/02*** | (2006.01) |
| ***B05C 13/02*** | (2006.01) |
| ***B05C 9/14*** | (2006.01) |
| ***F26B 15/12*** | (2006.01) |

(52) U.S. Cl.
CPC ..... *B05C 13/02* (2013.01); *B05C 9/14* (2013.01); *F26B 15/12* (2013.01); *F26B 2210/12* (2013.01)

(58) Field of Classification Search
CPC ..... B05D 3/0413; B05C 13/02; B05C 9/14; F26B 15/12
See application file for complete search history.

(56) References Cited

U.S. PATENT DOCUMENTS 4,771,552 A * 9/1988 Morioka ..... F26B 15/12 34/222
6,248,172 B1 6/2001 Shirotani et al.

FOREIGN PATENT DOCUMENTS

| | | | |
|---|---|---|---|
| CN | 204448463 U | * | 7/2015 |
| JP | 04028108 U1 | | 3/1992 |
| JP | H05076822 A | | 3/1993 |
| JP | H06000225 A | | 1/1994 |
| JP | H10249261 A | | 9/1998 |
| JP | H11262706 A | | 9/1999 |
| JP | 2000070821 A | | 3/2000 |
| JP | 2006272165 A | * | 10/2006 |
| JP | 2009195840 A | | 9/2009 |

* cited by examiner

*Primary Examiner* — Nathan H Empie
(74) *Attorney, Agent, or Firm* — Young Basile Hanlon & MacFarlane, P.C.

(57) ABSTRACT

A paint baking method includes a process for conveying a vehicle body while exposing the vehicle body to a hot air atmosphere to bake a wet coating film applied to the vehicle body. In the vehicle body, hinges and door offset members are attached between hinge fastening parts of the main shell body and hinge fastening parts of the side doors. The distance between the hinge fastening parts of the main shell body and the hinge fastening parts of the side door in a state in which the hinges and the door offset members are attached is longer than a distance between the hinge fastening parts of the main shell body and the hinge fastening parts of the side door in a finished vehicle state.

19 Claims, 23 Drawing Sheets

PAINT BAKING METHOD AND DOOR OFFSET DEVICE FOR VEHICLE BODY COATING PROCESS

TECHNICAL FIELD

The present invention relates to a paint baking method and a door offset device for vehicle body coating process which is preferably used in the paint baking method.

BACKGROUND

For the purposes of productivity improvement and adjustability of body color in a coating process line for vehicle bodies, various processes are performed, such as processes for an electrodeposition coat (under coat), intermediate coat and topcoat and antirust treatment, in a state in which lid parts such as doors and hoods are attached to main shell bodies. In the processes for an intermediate coat and topcoat, the vehicle body as an object to be coated is placed on a transfer trolley, applied with paint while being conveyed in a paint coating booth, and followed by a baking process in which the vehicle body, together with the transfer trolley, is carried into a paint baking oven to perform baking of a wet coating film. The paint baking oven used in the coating process line is configured such that a tunnel-shaped oven body is provided with an air supply duct for hot air and the hot air is blown to the whole vehicle body, which is being conveyed in the oven body, to bake the wet coating film (See Japanese Patent Application Publication No. JP06-000225).

A baking curable-type paint is used for vehicle bodies. The quality assurance standard for the cured coating film is, for example, holding of 140° C.×20 minutes for an intermediate paint and topcoat paint. In the conventional paint baking oven, however, the hot air is less likely to go around into narrow portions, such as those around hinges of doors, because of the structure of the vehicle body as compared with the body exterior parts to which the hot air is easy to blow. Thus, unfortunately, the narrow portions cannot readily satisfy the above-described quality assurance standard, such as holding of 140° C.×20 minutes.

SUMMARY

A problem to be solved by the present invention is to provide a paint baking method and a door offset device for vehicle body coating process that are able to satisfy the baking condition for a wet coating film across the whole vehicle body.

The present invention solves the above problem by providing a paint baking method that includes attaching a hinge and a door offset member between a hinge fastening part of a main shell body of a vehicle body and a hinge fastening part of a side door and conveying the vehicle body while exposing the vehicle body to a hot air atmosphere to bake a wet coating film applied to the vehicle body. The door offset member is attached between the hinge and the main shell body or between the hinge and the side door. The distance between the hinge fastening part of the main shell body and the hinge fastening part of the side door in a state in which the hinge and the door offset member are attached is longer than a distance between the hinge fastening part of the main shell body and the hinge fastening part of the side door in a finished vehicle state.

According to the present invention, the door offset member is attached between the hinge and the main shell body or between the hinge and the side door, and the distance between the hinge fastening part of the main shell body and the hinge fastening part of the side door is thereby longer than that in the finished vehicle state. This allows a sufficient space to be generated in the vicinity of the hinge which is narrow in the finished vehicle state. When the vehicle body is exposed to the hot air atmosphere, therefore, the hot air goes around into the vicinity of the hinge. Consequently, the baking condition for the wet coating film can be satisfied across the whole vehicle body B.

DETAILED DESCRIPTION OF THE EMBODIMENTS

Figure 1A:
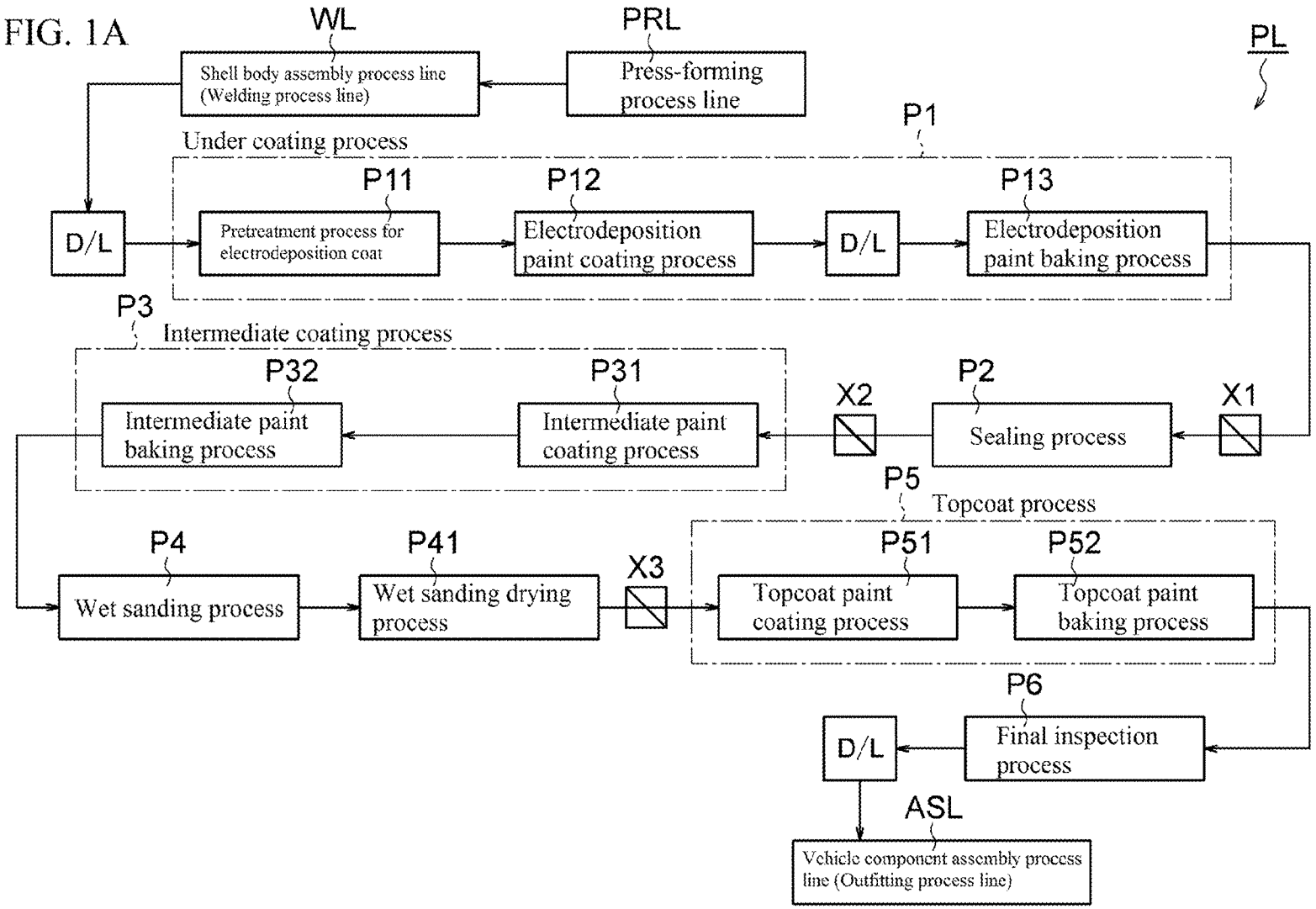
FIG. 1A is an overall process chart illustrating an example of a coating process line to which one or more embodiments of the paint baking method according to the present invention are applied.

Hereinafter, best modes for carrying out the present invention will be described with reference to one or more embodiments in which the paint baking method and door offset device for vehicle body coating process of the present invention are applied to a topcoat paint baking oven 1, but the paint baking method and door offset device for vehicle body coating process of the present invention can also be applied to an intermediate paint baking oven and an under paint baking oven (electrodeposition paint baking oven), or to an intermediate paint and topcoat paint baking oven which will be described later, other than the topcoat paint baking oven. That is, the overview of the paint baking method of the present invention is to offset side doors using the door offset device for vehicle body coating process according to another aspect of the present invention and, in this state, pass the vehicle body at least through a paint baking oven such as a topcoat paint baking oven.

The topcoat paint baking oven 1 according to one or more embodiments of the present invention is one of devices that constitute a coating process line PL. The topcoat paint baking oven 1 is a device for baking a top coating film, which is applied to a shell body B (referred also to as a "vehicle body B") loaded on a transfer trolley 50, to the vehicle body B. In the following description, the overview of a production line and the coating process line PL for vehicles will first be described and the vehicle body B and the topcoat paint baking oven 1 will then be described in detail.

The production line for vehicles is composed mainly of four lines: a press-forming process line PRL; a shell body assembly process line (referred also to as a "welding process line") WL; a coating process line PL; and a vehicle component assembly process line (referred also to as an "outfitting process line") ASL. In the press-forming process line PRL, various panels that constitute a vehicle body B are press-formed and each conveyed in a state of a single pressed component to the shell body assembly process line WL. In the shell body assembly process line WL, subassemblies are assembled for respective sites of the vehicle body, such as a front body, center floor body, rear floor body and side bodies, and welding is performed for predetermined parts of the assembled front body, center floor body and rear floor body to assemble an under body, to which the side bodies and a roof panel are welded to assemble a main shell body B1 (which refers to a shell body excluding lid parts). Finally, preassembled lid parts such as a hood F, side doors D1 and D2 and trunk lid T (or back door) are attached to the main shell body B1 via hinges. After passing through the coating process line PL, the shell body finished with coating is conveyed to the vehicle component assembly process line ASL, in which various vehicle components such as an engine, transmission, suspension devices and interior components are assembled into the shell body. As will be described later, in the shell body assembly process line in which the lid parts are attached to the main shell body B1 via hinges, door offset devices for vehicle body coating process (referred also to as "door offset members 70," hereinafter) may be attached thereto.

Figure 1B:
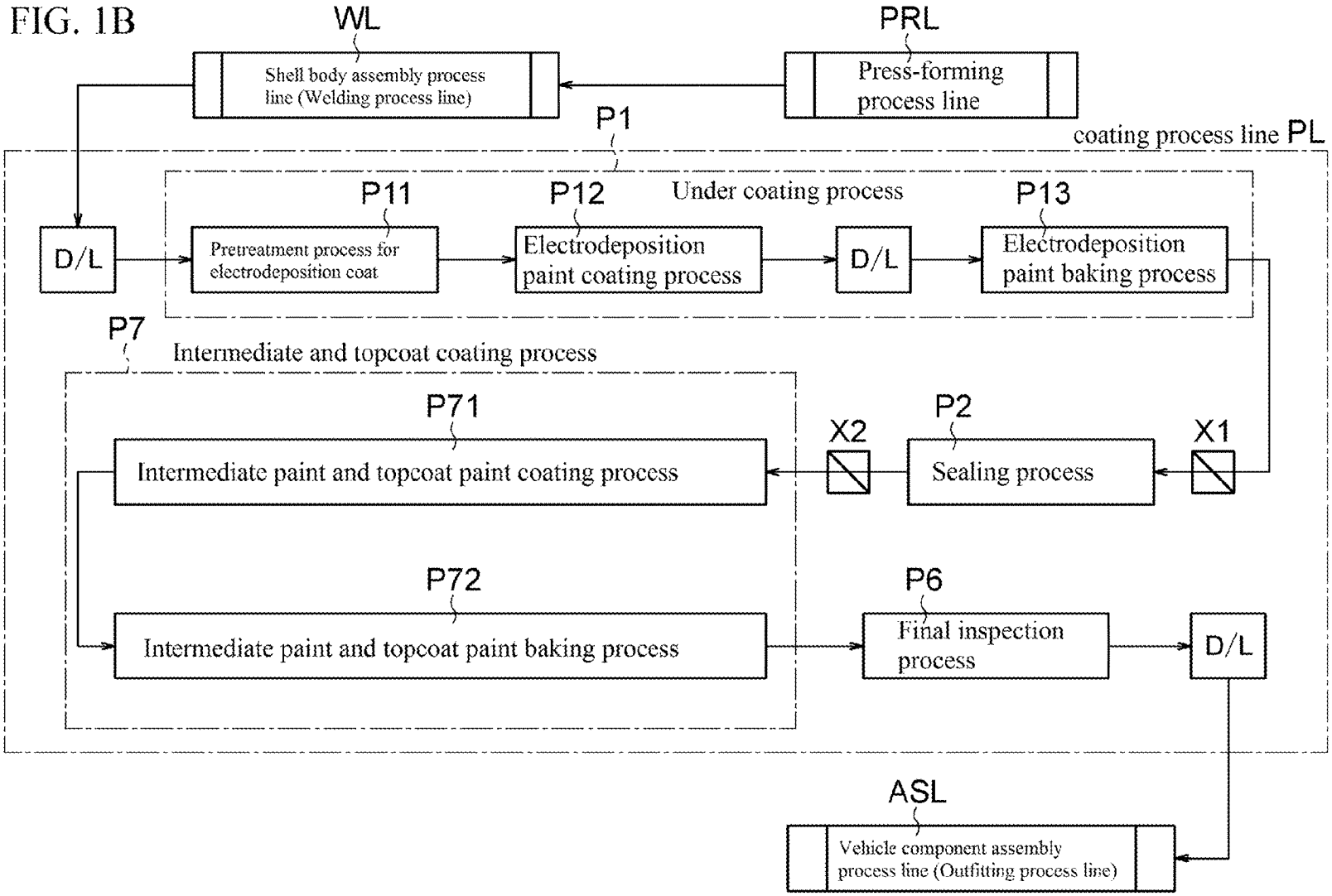
FIG. 1B is an overall process chart illustrating another example of a coating process line to which one or more embodiments of the paint baking method according to the present invention are applied.

General configuration of the coating process line PL will then be described. FIG. 1A and FIG. 1B are each an overall process chart illustrating the coating process line PL including a topcoat paint baking oven to which the paint baking method of the present invention is applied. The coating process line PL of the embodiment illustrated in FIG. 1A is a coating process line using a three-coat three-bake coating method of under coating, intermediate coating and top coating. In contrast, the coating process line PL of the embodiment illustrated in FIG. 1B is a coating process line using a three-coat two-bake coating method in which coating with an intermediate paint and a topcoat paint is performed in a wet-on-wet condition (a condition of coating an uncured coating film with another paint, here and hereinafter) in the same coating booth and the intermediate coating film and the top coating film are simultaneously baked in the same paint baking oven. Thus, the paint baking method of the present invention can be applied to both the coating process lines with different coating methods. The paint baking method of the present invention can also be applied to various cases by modifying a part of this kind of typical coating process line PL. Such cases include a case of four-coat coating method in which the three-coat three-bake coating method and the three-coat two-bake coating method are modified to perform the intermediate coating twice and a case in which the topcoat color is an optional body color, such as two-tone color. The following description is in line with both the coating process lines of FIG. 1A and FIG. 1B. Common features are denoted by the same characters and will be described with reference to the coating process line of FIG. 1A. With regard to different features between the coating process lines of FIG. 1A and FIG. 1B, the difference will be described with reference to FIG. 1B.

The coating process line PL of the embodiment illustrated in FIG. 1A comprises an under coating process P1, sealing process P2, intermediate coating process P3, wet sanding process P4, topcoat process P5, and final inspection process P6. In contrast, the coating process line PL of the embodiment illustrated in FIG. 1B comprises an under coating process P1, sealing process P2, intermediate and topcoat coating process P7, and final inspection process P6. That is, in the coating process line PL of FIG. 1B, two processes of an intermediate paint coating process P31 and topcoat paint coating process P51 illustrated in FIG. 1A are performed in one process of an intermediate paint and topcoat paint coating process P71 of FIG. 1B and, similarly, an intermediate paint baking process P32 and topcoat paint baking process P52 illustrated in FIG. 1A are performed in one process of an intermediate paint and topcoat paint baking process P72 of FIG. 1B. The intermediate and topcoat coating process P7 of FIG. 1B will be described later.

As illustrated in FIG. 1A and FIG. 1B, the under coating process P1 comprises an pretreatment process for electrodeposition coat P11, electrodeposition paint coating process P12, and electrodeposition paint baking process P13. In the pretreatment process for electrodeposition coat P11, the vehicle bodies B (white bodies), which are each transferred from the transfer trolley of the shell body assembly process line WL to a hanger (not illustrated) using a drop-lifter D/L, are successively conveyed by an overhead conveyor with a predetermined pitch at a predetermined conveying speed. The structure of a vehicle body B will be described later.

Although not illustrated, in general, the pretreatment process for electrodeposition coat P11 comprises a degreasing process, water-washing process, surface conditioning process, chemical conversion film forming process, water-washing process, and water-draining process. In the press-forming process line PRL and the shell body assembly process line WL, press oil and dust such as iron powder due to welding are attached to the vehicle body B. When the vehicle body B is carried into the coating process line PL, therefore, the degreasing process and the water-washing process are used to wash and remove such oil and dust. In the surface conditioning process, surface conditioner components are adsorbed to the surface of the vehicle body B thereby to increase the number of reaction starting points in the subsequent chemical conversion film forming process. The adsorbed surface conditioner components act as nuclei of coating film crystals to accelerate the film forming reaction. In the chemical conversion film forming process, the vehicle body B is immersed in a chemical conversion treatment liquid, such as zinc phosphate solution, to form a chemical conversion film on the surface of the vehicle body B. In the water-washing process and the water-draining process, the vehicle body B is washed with water and then dried.

In the electrodeposition paint coating process P12, the vehicle bodies B pretreated in the pretreatment process for electrodeposition coat P11 are successively conveyed by an overhead conveyor with a predetermined pitch at a predetermined conveying speed. Each vehicle body B is then immersed in a boat-shaped electrodeposition bath that is filled with an electrodeposition paint and a high voltage is applied between a plurality of electrode plates provided in the electrodeposition bath and the vehicle body B (specifically a hanger having electrical conductivity). This allows the surface of the vehicle body B to be formed with an electrodeposition coating film owing to the electrophoretic action of the electrodeposition paint. Examples of the electrodeposition paint include a thermoset paint of which the primary resin is an epoxy-based resin such as polyamine resin. For the antirust property, it is preferred to use a cation-type electrodeposition paint as the electrodeposition paint, in which case a high voltage for the positive electrode is applied to the side of the electrodeposition paint, but an anion-type electrodeposition paint may also be used. When the anion-type electrodeposition paint is used, a high voltage for the positive electrode is applied to the side of the vehicle body B.

After exiting the electrodeposition bath of the electrodeposition paint coating process P12, the vehicle body B is conveyed to a water-washing process in which the electrodeposition paint attached to the vehicle body B is washed away using industrial water and/or pure water. During this operation, the electrodeposition paint carried out of the electrodeposition bath is recovered in the water-washing process. At the stage completed with the water-washing process, an unbaked electrodeposition coating film having a thickness of about 10 to 35 μm is formed on the surface of the vehicle body B and in the hollow structure parts of the vehicle body B. After completion of the electrodeposition paint coating process P12, the vehicle body B loaded on a hanger is transferred to a transfer trolley 50 (which will be described later with reference to FIG. 2A) using a drop-lifter D/L. The drop-lifter D/L disposed between the electrodeposition paint coating process P12 and the electrodeposition paint baking process P13 illustrated in FIG. 1A and FIG. 1B may otherwise be disposed between the electrodeposition paint baking process P13 and the sealing process P2 and, in the electrodeposition paint baking process P13, the vehicle body may be conveyed in a state of being loaded on a hanger.

In the electrodeposition paint baking process P13, the vehicle bodes B loaded on transfer trolleys are successively conveyed by a floor conveyor with a predetermined pitch at a predetermined conveying speed. Then, for each vehicle body B, baking is performed by maintaining a temperature of 160° C. to 180° C. for 15 to 30 minutes, for example, and a baked electrodeposition coating film having a thickness of 10 to 35 μm is thereby formed on the interior and exterior of the vehicle body B and in the hollow structure parts of the vehicle body B. From the electrodeposition paint baking process P13 to the final inspection process P6, transfer trolleys 50 loaded with vehicle bodies B are successively conveyed using a floor conveyor, but the conveying pitch and conveying speed of the transfer trolleys 50 in each process are appropriately set for the process. The floor conveyor is therefore composed of a plurality of conveyors and the conveying pitch and conveying speed in each process are set as predetermined values.

In the present description and scope of claims, the "paint" such as an electrodeposition paint, intermediate paint and topcoat paint refers to a liquid state before being applied to an object to be coated while the "coating film" such as an electrodeposition coating film, intermediate coating film and top coating film refers to a film-like, unbaked (wet) or baked state after being applied to an object to be coated, and both are thus distinguished. In the present description and scope of claims, the upstream side and the downstream side mean those with reference to the conveying direction of the vehicle body B as an object to be coated.

In the sealing process P2 (which includes a floor back coating process and a stone-guard coating process), the vehicle body B formed with the electrodeposition coating film is conveyed and a sealing material of vinyl chloride-based resin is applied to joining parts of steel panels and edge parts of steel panels for the purpose of antirust or sealing. In the floor back coating process, a vinyl chloride resin-based anti-flipped stone material is applied to wheel housings and a floor back of the vehicle body B. In the stone-guard coating process, an anti-flipped stone material of polyester-based resin or polyurethane-based resin is applied to lower portions of the body exterior, such as side sill panels, fender panels and doors. These sealing material and anti-flipped stone material are to be cured in a dedicated baking process or in the intermediate paint baking process P32 which will be described below.

The intermediate coating process P3 of the coating process line PL of FIG. 1A comprises an intermediate paint coating process P31 and an intermediate paint baking process P32. In the intermediate paint coating process P31, the vehicle body B formed with the electrodeposition coating film is conveyed to an intermediate paint coating booth in which an interior coating paint is applied to the body interior parts of the vehicle body, such as an engine room, hood inner and trunk lid inner. The interior coating paint contains a coloring pigment corresponding to an exterior body color of the vehicle. Then, an intermediate paint is applied to the body exterior parts, such as a hood outer, roof, door outers and trunk lid outer (or back door outer), in a wet-on-wet condition (i.e. without baking the interior coating film). As used herein, the body exterior parts refer to parts that are visible from outside the vehicle finished with the outfitting process and the body interior parts refer to parts that are invisible from outside the finished vehicle.

In the intermediate paint baking process P32 of the coating process line PL of FIG. 1, the vehicle body B is conveyed to an intermediate paint baking oven. Then, the unbaked intermediate coating film is baked by maintaining a temperature of 130° C. to 150° C. for 15 to 30 minutes, for example, and an intermediate coating film having a thickness of 15 to 35 μm is formed on the body exterior parts of the vehicle body B. The interior coating film having a thickness of 15 to 30 μm is also formed on the body interior parts of the vehicle body B. Each of the interior coating paint and the intermediate paint is a thermoset paint of which the primary resin is an appropriate resin, such as acrylic resin, alkyd resin and polyester resin, and may be any of an aqueous paint and organic solvent-based paint.

In the wet sanding process P4 of the coating process line PL of FIG. 1A, the vehicle body B finished with the intermediate coating process P3 and preceding processes is conveyed and the surface of the intermediate coating film formed on the vehicle body B is polished using clean water and a polishing agent. This enhances the interfacial adhesion between the intermediate coating film and the top coating film and improves the smoothness (coating skin and image sharpness/gloss) of the top coating film on the body exterior parts. The wet sanding process P4 is provided with a wet sanding drying process P41 in which the vehicle body B passes through a water-draining oven thereby to dry the water attached to the vehicle body B.

The topcoat process P5 of the coating process line PL of FIG. 1A comprises a topcoat paint coating process P51 and a topcoat paint baking process P52. In the topcoat paint coating process P51, the vehicle body B finished with the wet sanding process P4 and the wet sanding drying process P41 is conveyed. Then, in the topcoat paint coating booth, a topcoat base paint is applied to the body exterior parts of the vehicle body B and a topcoat clear paint is applied to the topcoat base coating film on the body exterior parts of the vehicle body B in a wet-on-wet condition.

Each of the topcoat base paint and the topcoat clear paint is a paint of which the primary resin is an appropriate resin, such as acrylic resin, alkyd resin and polyester resin, and may be any of an aqueous paint and organic solvent-based paint. In consideration of the finishing property such as orientation of bright pigment, the topcoat base paint is diluted to about 80% as the weight ratio for coating (solid content is about 20% to 40%) while the topcoat clear paint is diluted to about 30% as the weight ratio for coating (solid content is about 70% to 80%). In general, however, the applied solid content of the topcoat base paint will increase to 70% or more in a flash-off process (setting process in which the solvent naturally evaporates in the booth) after the application.

The exterior body color of the vehicle body B according to one or more embodiments of the present invention is a metallic-type body color that contains various bright pigments such as aluminum and mica, so the topcoat base paint and the topcoat clear paint are applied to the vehicle body B, but the present invention is not limited to this. For example, the exterior body color of the vehicle body B may be a solid-type body color. The solid-type body color is a coating color that does not contain a bright pigment. In this case, the topcoat base paint is not applied and a topcoat solid paint is applied as substitute for the topcoat clear paint. Examples of such a topcoat solid paint include paints of which the primary resin is the same as that of the topcoat base paint and the topcoat clear paint.

In the topcoat paint baking process P52 according to one or more embodiments of the present invention, the vehicle body B to which the topcoat paint is applied in the topcoat paint coating booth is conveyed to the topcoat paint baking oven 1. In the topcoat paint baking process P52, the vehicle body B is passed through the topcoat paint baking oven 1 under a predetermined condition thereby to form a baked top coating film. Specific configuration of the topcoat paint baking oven 1 and topcoat paint baking process P52 according to one or more embodiments of the present invention will be described later.

The thickness of the topcoat base coating film is, for example, 10 to 20 μm and the thickness of the topcoat clear coating film is, for example, 15 to 30 μm. When the exterior body color is a solid-type body color, the thickness of the topcoat solid coating film is, for example, 15 to 35 μm. Finally, the vehicle body completed with all the above processes (vehicle body finished with coating) is conveyed to the final inspection process P6 in which various tests are performed for evaluation of properties, such as appearance and image sharpness of the coating film.

On the other hand, the coating process line PL illustrated in FIG. 1B includes the intermediate and topcoat coating process P7 which is provided as substitute for the intermediate coating process P3, wet sanding process P4 (including wet sanding drying process P41), and topcoat process P5 of the coating process line PL illustrated in FIG. 1A. The intermediate and topcoat coating process P7 of this embodiment comprises an intermediate paint and topcoat paint coating process P71 and an intermediate paint and topcoat paint baking process P72.

In the intermediate paint and topcoat paint coating process P71 of the coating process line PL illustrated in FIG. 1B, the vehicle body B formed with the electrodeposition coating film is conveyed to an intermediate paint and topcoat paint coating booth that includes a first-half zone and a second-half zone. In the first-half zone, an interior coating paint is applied to the body interior parts of the vehicle body, such as an engine room, hood inner and trunk lid inner. The interior coating paint contains a coloring pigment corresponding to an exterior body color of the vehicle. Then, an intermediate paint is applied to the body exterior parts, such as a hood outer, roof, door outers and trunk lid outer (or back door outer), in a wet-on-wet condition (i.e. without baking the interior coating film). Then, similarly, in the second-half zone of the intermediate paint and topcoat paint coating booth, a topcoat base paint is applied to the body exterior parts of the vehicle body B and a topcoat clear paint is applied to the topcoat base coating film on the body exterior parts of the vehicle body B in a wet-on-wet condition. That is, the interior coating paint, intermediate paint, topcoat base paint and clear paint are all applied in a wet-on-wet condition and simultaneously baked in one topcoat paint baking oven. To suppress troubles of generation of bubbles and deterioration in the image sharpness due to double coating of wet coating films, after the intermediate paint is applied and/or after the topcoat base paint is applied, a flash-off process may be provided for increasing the painted non-volatility value of the wet coating film applied to the vehicle body B. Each of the interior coating paint, intermediate paint, topcoat base paint and clear paint used in this embodiment is a thermoset paint of which the primary resin is an appropriate resin, such as acrylic resin, alkyd resin and polyester resin, as used in the coating process line PL illustrated in FIG. 1A, and may be any of an aqueous paint and organic solvent-based paint.

Figure 2A:
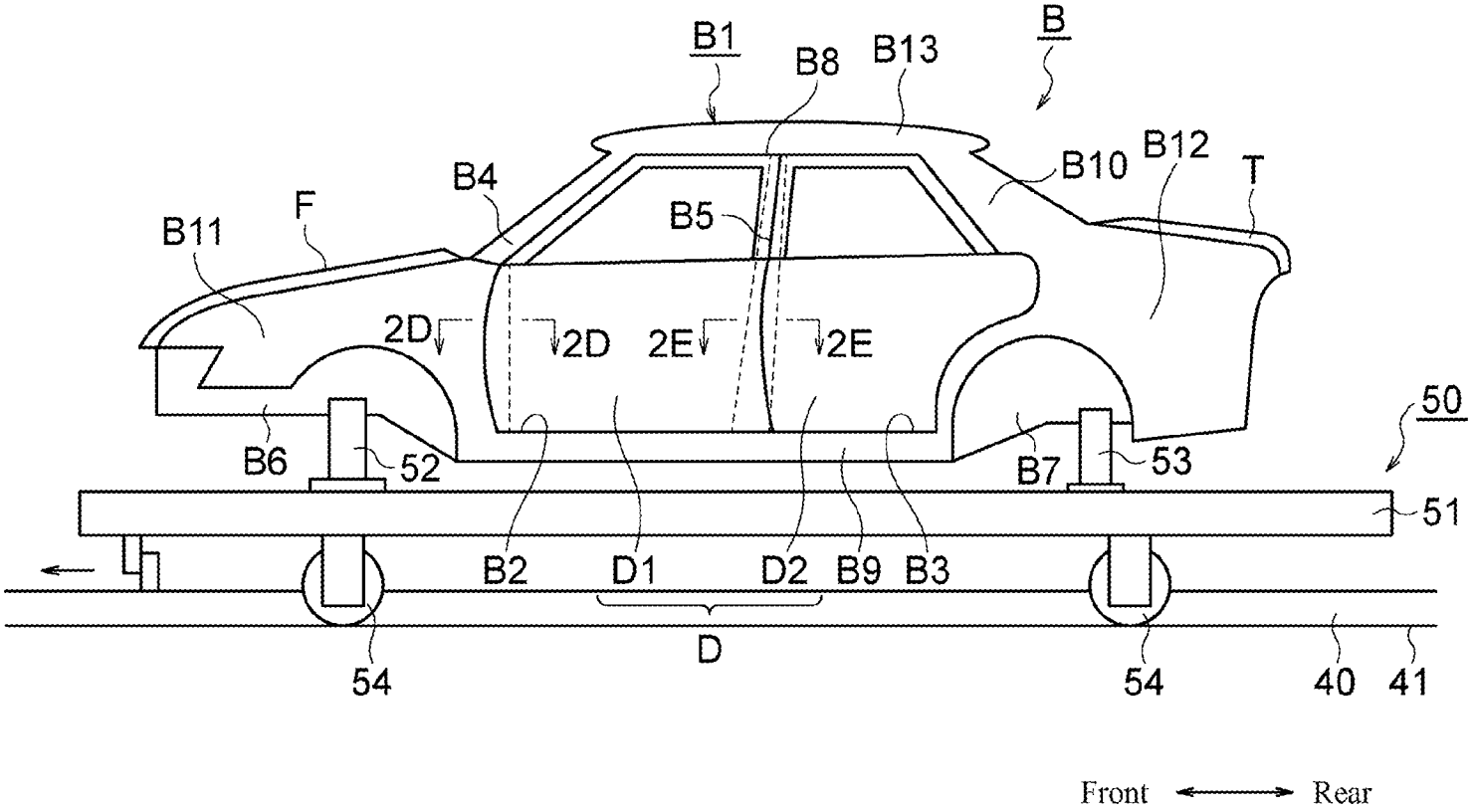
FIG. 2A is a side elevational view illustrating a state in which a vehicle body according to one or more embodiments of the present invention is loaded on a transfer trolley.
Figure 2B:
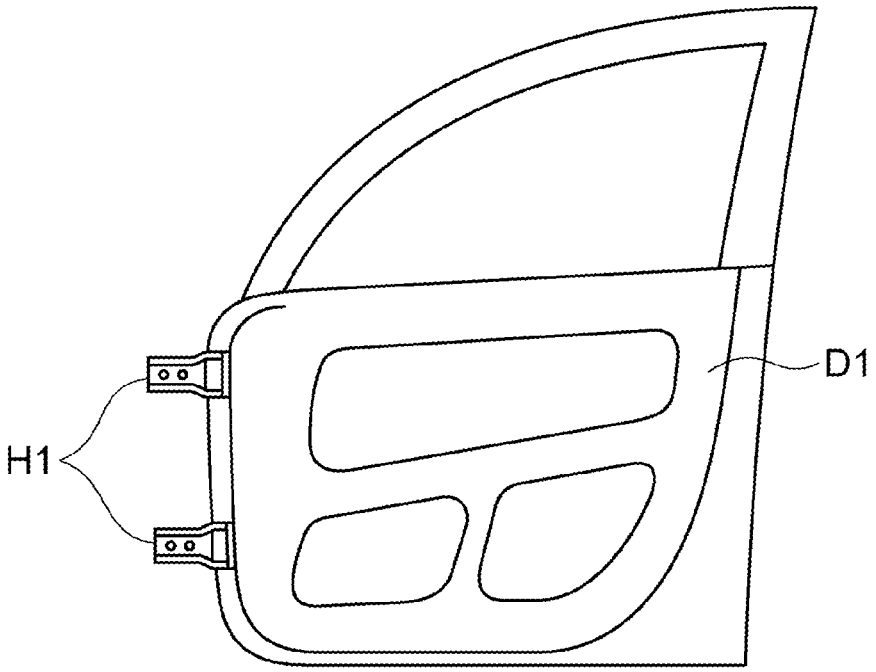
FIG. 2B is a front elevational view of a front door of a vehicle body according to one or more embodiments of the present invention when viewed from the interior side.
Figure 2C:
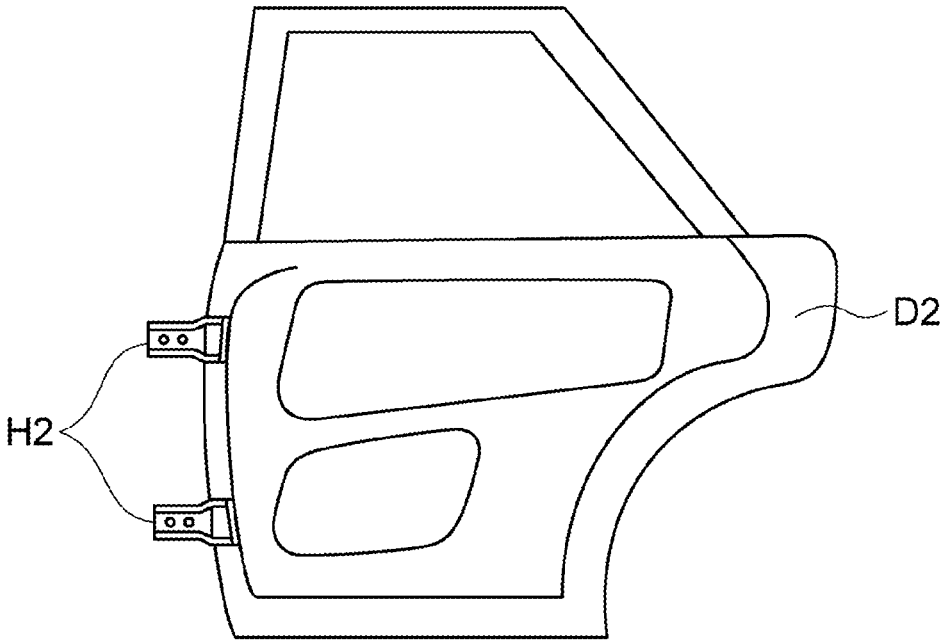
FIG. 2C is a front elevational view of a rear door of a vehicle body according to one or more embodiments of the present invention when viewed from the interior side.
Figure 2D:
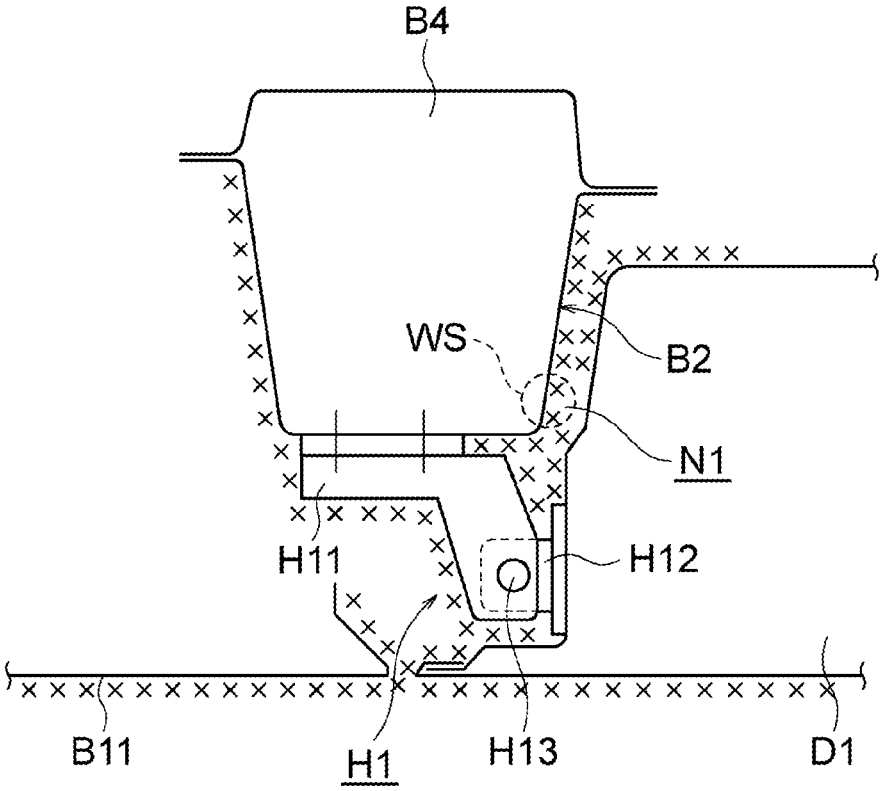
FIG. 2D is a cross-sectional view along line 2D-2D of FIG. 2A in a finished vehicle state (state in which a door offset member is not attached), that is, a cross-sectional view illustrating an example of a narrow portion including a front pillar, front door and hinge.
Figure 2E:
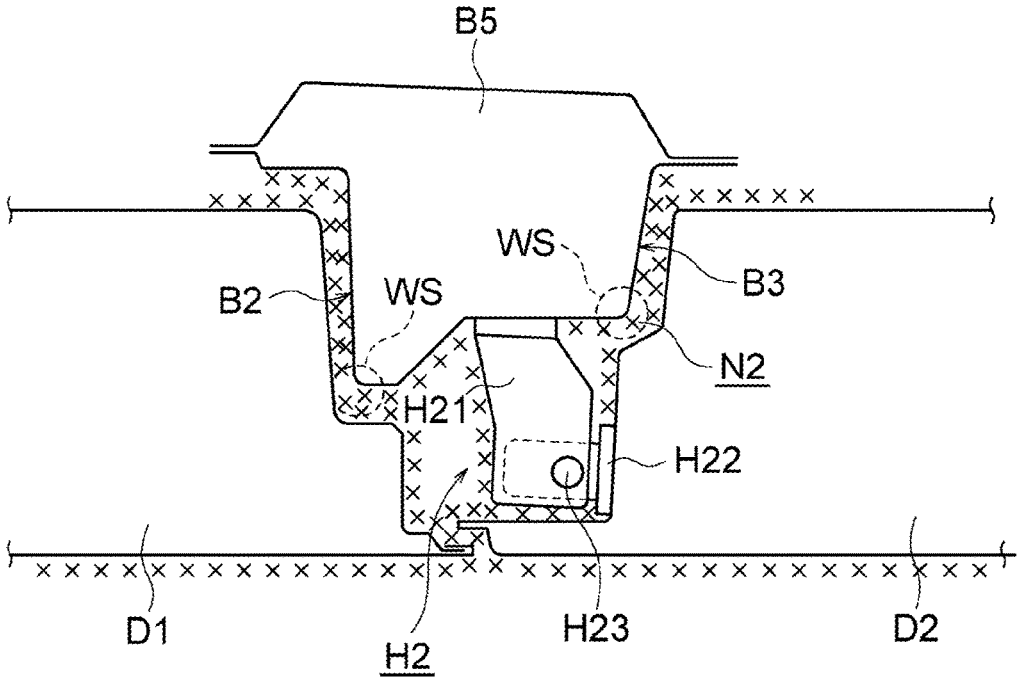
FIG. 2E is a cross-sectional view along line 2E-2E of FIG. 2A in a finished vehicle state (state in which a door offset member is not attached), that is, a cross-sectional view illustrating an example of a narrow portion including a center pillar, rear door and hinge.
Figure 2F:
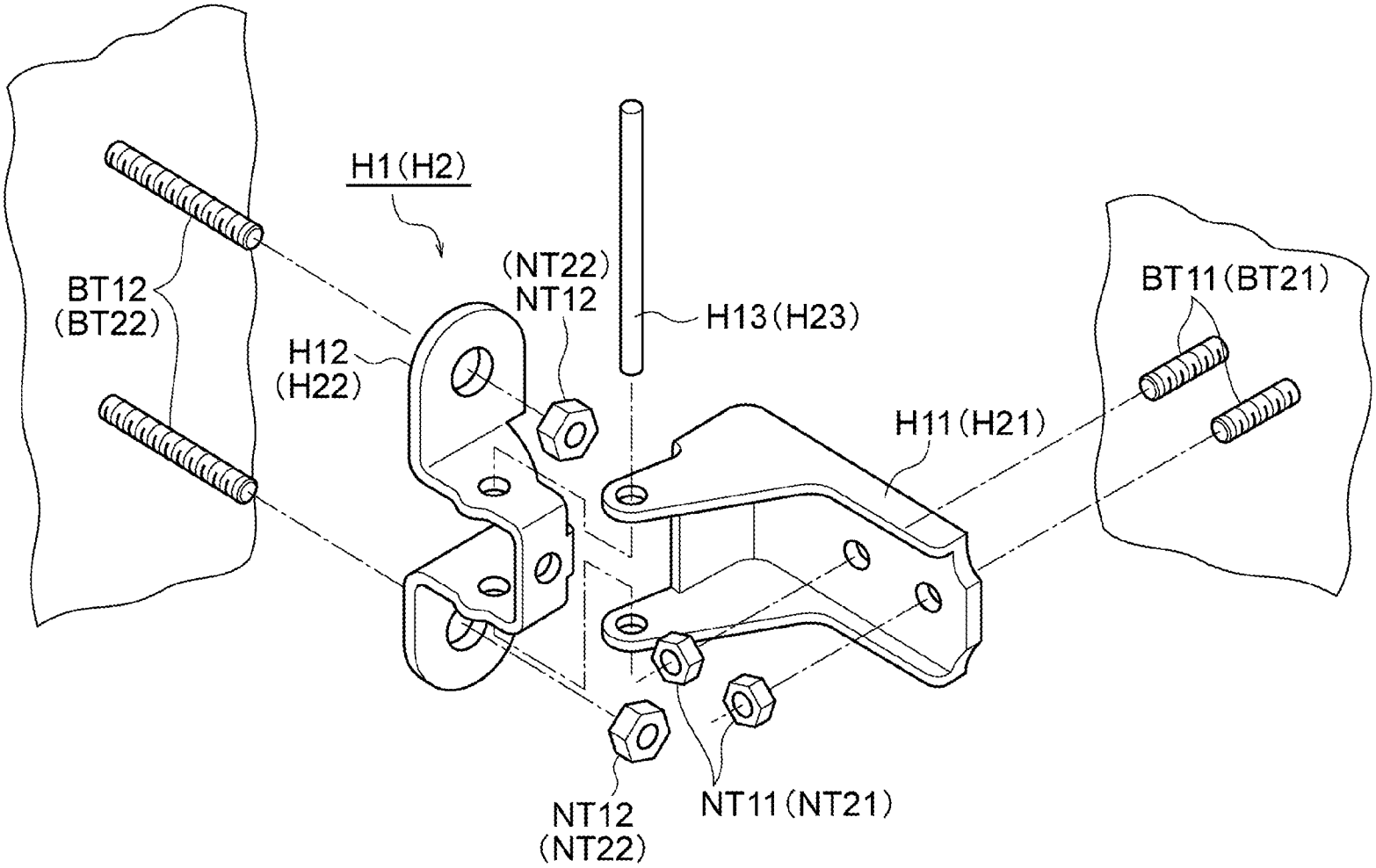
FIG. 2F is an exploded perspective view illustrating an example of hinges of FIG. 2B and FIG. 2C.
Figure 2G:
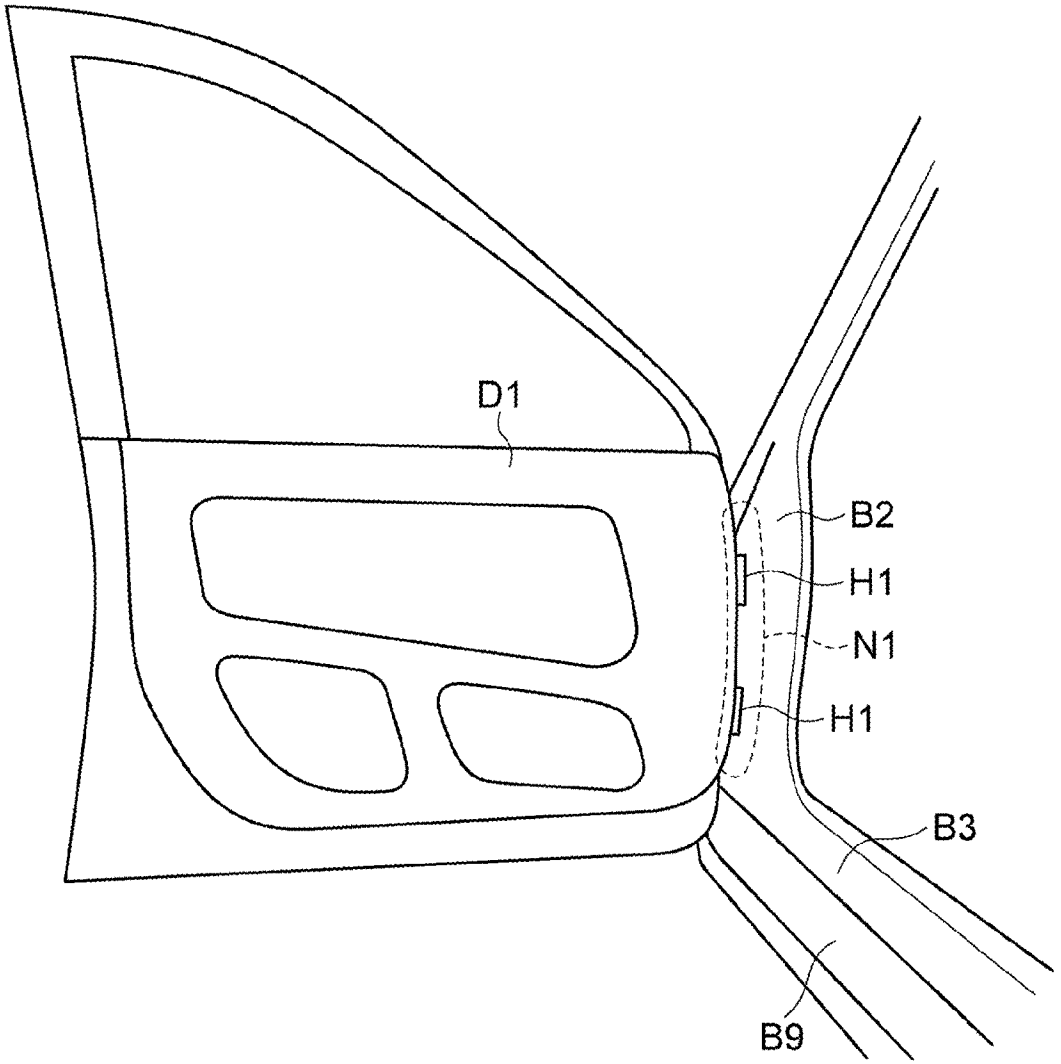
FIG. 2G is a view of a state in which the front door of a vehicle body in a finished vehicle state according to one or more embodiments of the present invention is opened, when viewed from behind a main shell body.
Figure 2H:
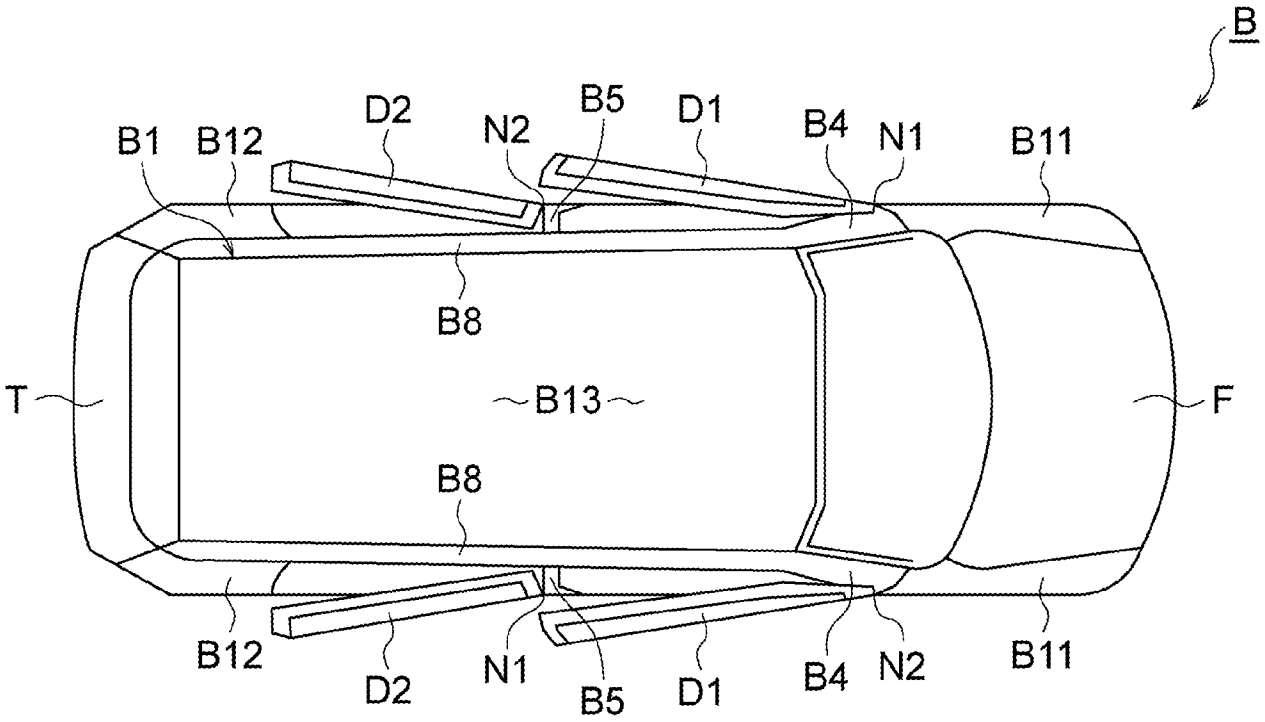
FIG. 2H is a plan view illustrating an opening degree of side doors in a finished vehicle state of a vehicle body according to one or more embodiments of the present invention.

Next, an example of the vehicle body B applied to the coating process line PL according to one or more embodiments of the present invention will be described in detail with reference to FIG. 2A to FIG. 2H. FIG. 2A is a side elevational view illustrating a state in which the vehicle body B according to one or more embodiments of the present invention is loaded on the transfer trolley 50, FIG. 2B is a front elevational view of a front door D1 of the vehicle body B according to one or more embodiments of the present invention when viewed from the interior side, FIG. 2C is a front elevational view of a rear door D2 of the vehicle body B according to one or more embodiments of the present invention when viewed from the interior side, FIG. 2D is a cross-sectional view along line 2D-2D of FIG. 2A in a finished vehicle state (state in which a door offset member 70 is not attached), that is, a cross-sectional view illustrating an example of a narrow portion N1 including a front pillar B4, front door D1 and hinge H1, FIG. 2E is a cross-sectional view along line 2E-2E of FIG. 2A in a finished vehicle state (state in which a door offset member 70 is not attached), that is, a cross-sectional view illustrating an example of a narrow portion N2 including a center pillar B5, rear door D2 and hinge H2, FIG. 2F is an exploded perspective view illustrating an example of the hinges H1 and H2 of FIG. 2B and FIG. 2C, FIG. 2G is a view of a state in which the front door D1 of the vehicle body B in a finished vehicle state according to one or more embodiments of the present invention is opened, when viewed from behind the main shell body, and FIG. 2H is a plan view illustrating an opening degree of side doors in a finished vehicle state of a vehicle body according to one or more embodiments of the present invention. As used herein, the vehicle body B in a finished vehicle state refers to an originally designed state of the vehicle body B to which door offset members 70 to be described later are not attached, and this term is used to distinguish from a state in which the door offset members 70 are attached as in one or more embodiments of the present invention and the vehicle body B is conveyed in the topcoat paint baking oven 1.

The vehicle body B according to one or more embodiments of the present invention is the vehicle type of a four-door sedan, as illustrated in FIG. 2A, and therefore comprises a main shell body B1 and lid parts that include a hood F, front doors D1, rear doors D2 and a trunk lid T. Both side surfaces of the main shell body B1 are each formed with a front door opening part B2 and a rear door opening part B3. The front door opening part B2 is an opening that is defined by a front pillar B4, center pillar B5, roof side rail B8 and side sill B9 of the main shell body B1. The rear door opening part B3 is an opening that is defined by a center pillar B5, rear pillar B10, roof side rail B8 and side sill B9 of the main shell body B1. Hereinafter, the front door opening part B2 and the rear door opening part B3 are referred also to as "door opening parts B2 and B3" in a collective term. The trunk lid T illustrated as a lid part may be a back door depending on the vehicle type of the vehicle body B.

The vehicle body B according to one or more embodiments of the present invention is the vehicle type of a four-door sedan, as illustrated, and the side doors D at each side are therefore provided as a front door D1 and a rear door D2. In the case of a two-door sedan or a two-door coupe, each side has a front door D1 and a front door opening part B2 and does not have a rear door D2 and a rear door opening part B3. In one or more embodiments of the present invention, the front door D1 is arranged to correspond to the front door opening part B2 and the rear door D2 is arranged to correspond to the rear door opening part B3. In this case, the side doors D, which include the front doors D1 and the rear doors D2, correspond to an example of the side doors according to the present invention. In the cases of the above-described two-door sedan and two-door coupe, the front doors D1 correspond to an example of the side doors according to the present invention.

As illustrated in FIG. 2B and FIG. 2D, the front door D1 is provided with two hinges H1 at upper and lower positions of the front edge of the front door D1 (front side of the vehicle body B). As illustrated in FIG. 2C and FIG. 2E, the rear door D2 is provided with two hinges H2 at upper and lower positions of the front edge of the rear door D2 (front side of the vehicle body B). The hinges H1 and H2, which are for attaching the front doors D1 and the rear doors D2 to the main shell body B1 in an openable and closable manner, are different in shapes to some degree, but the basic structure is the same. One of the hinges H1 is therefore illustrated in FIG. 2F and illustration of the hinges H2 is omitted by denoting the corresponding reference numerals in parentheses.

As illustrated in FIG. 2F, the hinge H1 has two hinge brackets H11 and H12 and a hinge pin H13. The hinge bracket H12 is attached via bolts BT12, which are welded to the inner panel of the front door D1, and nuts NT12 while the hinge bracket H11 is attached via bolts BT11, which are welded to the front pillar B4 of the main shell body B1, and nuts NT11. The hinge pin H13 is inserted in four holes of the two hinge brackets H11 and H12 and fixed by means of swaging or press fitting. This allows the hinge brackets H11 and H12 to be coupled with each other in a rotatable manner around the hinge pin H13.

In the shell body assembly process line WL, a subassembly of each hinge H1 is preliminarily assembled such that the hinge pin H13 is inserted in four holes of the two hinge brackets H11 and H12 and fixed by means of swaging or press fitting, and the subassembly is carried into the final process. Before the front door D1 is attached to the main shell body B1, one hinge bracket H11 of the subassembly of each hinge H1 is fixed to the front door D1 using the bolts BT11 and nuts NT11, the front door D1 is then positioned with respect to the front door opening part B2 of the main shell body B1 using a jig and the like, and the other hinge bracket H12 is fixed to the front pillar B4 using the bolts BT12 and nuts NT12. This allows the front door D1 to move pivotally about the hinge pins H13 and the front door D1 can thus be opened and closed. The door offset members 70 according to one or more embodiments of the present invention may be attached in this process, as described above.

Similarly, the hinge H2 has two hinge brackets H21 and H22 and a hinge pin H23 as denoted by reference numerals in parentheses of FIG. 2F. The hinge bracket H21 is attached via bolts BT21, which are welded to the rear door D2, and nuts NT21 while the hinge H22 is attached via bolts BT22, which are welded to the center pillar B5 of the main shell body B1, and nuts NT22. The hinge pin H23 is inserted in holes of the two hinge brackets H21 and H22 and fixed by means of swaging or press fitting. This allows the hinge brackets H21 and H22 to be coupled with each other in a rotatable manner around the hinge pin H23. That is, the rear door D2 can move pivotally about the hinge pins H23 thereby to be openable and closable. Hereinafter, the hinges H1 and H2 will be referred to as "hinges H" in a collective term.

As illustrated in FIG. 2D, FIG. 2E, FIG. 2G and FIG. 2H, the vehicle body B in the finished vehicle state according to one or more embodiments of the present invention is formed with narrow portions N1 and N2 with a small space between the main shell body B1 and the side doors D. Specifically, as illustrated in FIG. 2D, FIG. 2G and FIG. 2H, the narrow portion N1 with a small space is formed in the vicinities of the front pillar B4 of the main shell body B1 and the hinges H1 to the front door D1 while, as illustrated in FIG. 2E and FIG. 2H, the narrow portion N2 with a small space is formed in the vicinities of the center pillar B5 of the main shell body B1 and the hinges H2 to the rear door D2. In particular, hot air from the paint baking oven 1 cannot readily get into the vicinities of the hinges H1 and H2 because they obstruct the hot air regardless of the opened or closed state of the front door D1 and the rear door D2, and the vicinities of the hinges H1 and H2 may not be readily heated due to the structural reason as compared with the body exterior parts of the vehicle body B. The vicinities of the hinges H1 and H2 are thus sites at which a predetermined temperature as the quality assurance standard for the coating film is difficult to be maintained for a predetermined time or longer. The cross marks "x" illustrated in FIG. 2D and FIG. 2E represent areas of the top coating and reference characters WS represent weatherstrips to be attached to the side doors D1 and D2 for sealing between the side doors D1 and D2 and the door opening parts B2 and B3. In particular, coated areas from the weatherstrips to the exterior are sites that are severely affected by a corrosive environment and require the coating quality, such as interfacial adhesion of the coating film, in addition to the quality of appearance.

Referring again to FIG. 2A, the above-described vehicle body B is conveyed from the electrodeposition paint baking process P13 to the final inspection process P6 of FIG. 1A and FIG. 1B in a state of being loaded on the transfer trolley 50. The transfer trolley 50 according to one or more embodiments of the present invention is made as a rectangular frame body in the plan view and has a base 51 composed of a rigid body that is enough to support the vehicle body B, four wheels 54 provided at the lower surface of the base 51, and two front attachments 52 and two rear attachments 53 provided at the upper surface of the base 51. The right and left front attachments 52 support right and left front under bodies B6 (such as front side members) of the vehicle body B, respectively, and the right and left rear attachments 53 support right and left rear under bodies B7 (such as rear side members) of the vehicle body B, respectively. These four attachments 52 and 53 horizontally support the vehicle body B. The four wheels 54 rotate along rails 41 that are laid at the right and left of a conveyor 40. In one or more embodiments of the present invention, when the vehicle body B is conveyed inside the topcoat paint baking oven 1, the vehicle body B is conveyed forward as will be described later in detail. That is, in the loaded state illustrated in FIG. 2A, the transfer trolley 50 and the vehicle body B are conveyed leftward. In an alternative embodiment, the vehicle body B may be conveyed backward.

Figure 3:
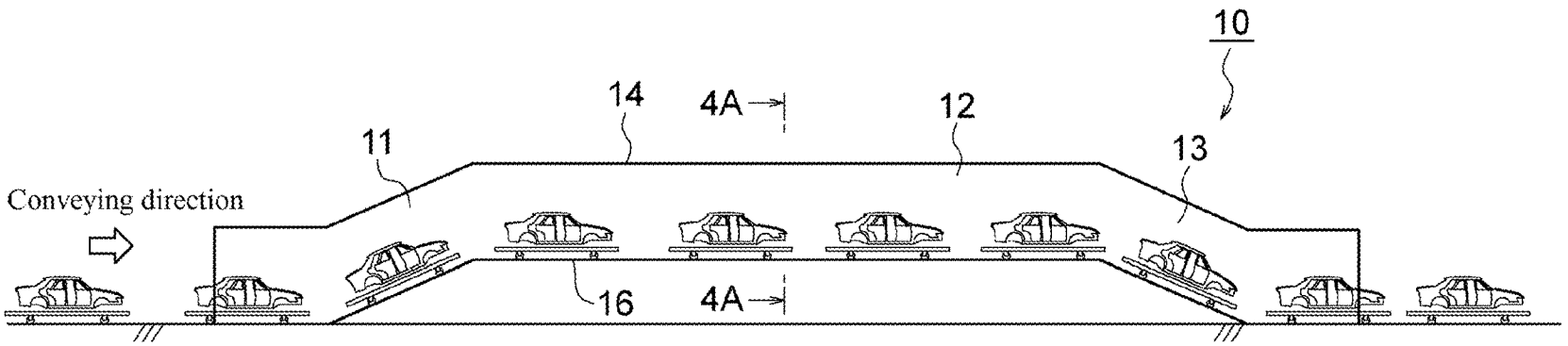
FIG. 3 is a side elevational view illustrating an oven body of a topcoat paint baking oven according to one or more embodiments of the present invention.

Next, the topcoat paint baking oven 1 according to one or more embodiments of the present invention will be described. FIG. 3 is a side elevational view illustrating a schematic configuration of the topcoat paint baking oven according to one or more embodiments of the present invention, FIG. 4A is a cross-sectional view along line 4A-4A of FIG. 3, and FIG. 4B is a fragmentary plan view of FIG. 3.

Figure 4A:
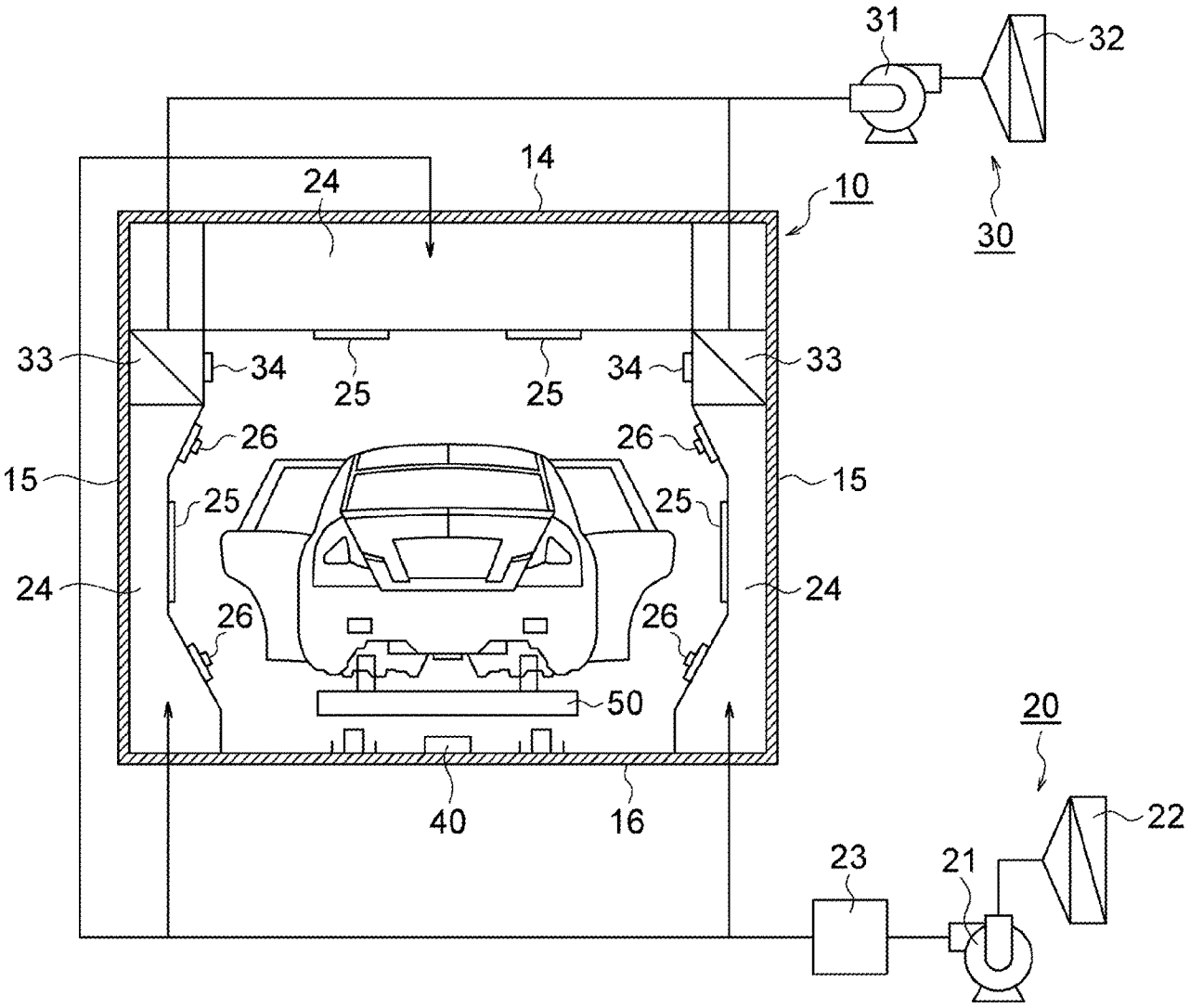
FIG. 4A is a cross-sectional view along line 4A-4A of FIG. 3.
Figure 4B:
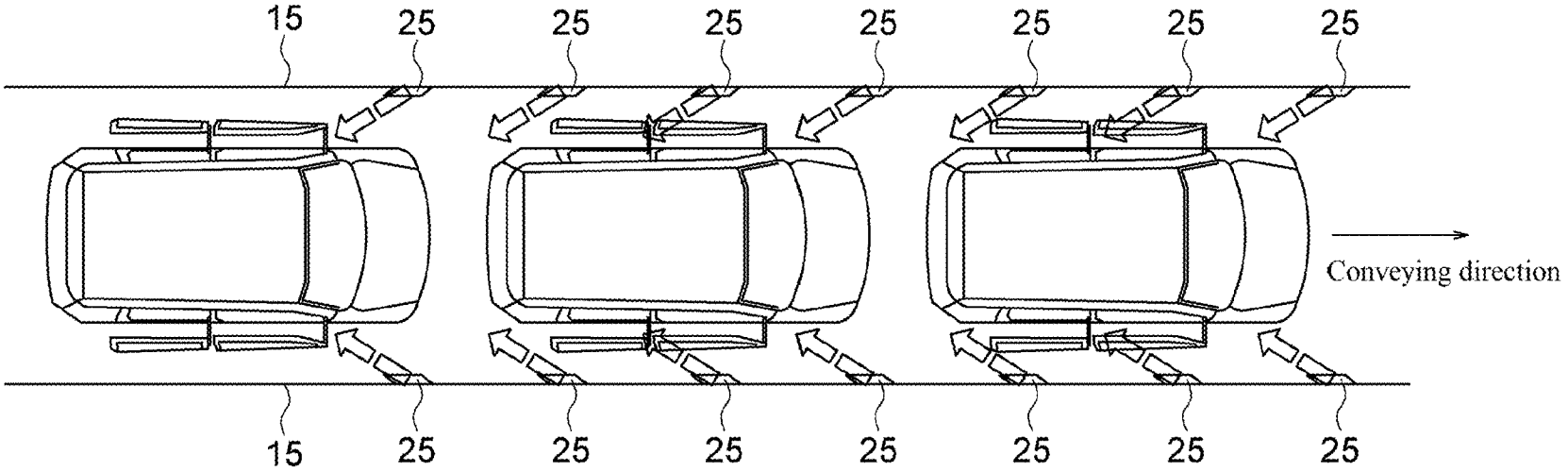
FIG. 4B is a fragmentary plan view of FIG. 3.

As illustrated in FIG. 3 and FIG. 4A, the topcoat paint baking oven 1 according to one or more embodiments of the present invention comprises an oven body 10, hot air supply device 20, and air exhauster 30. As illustrated in the side elevational view of FIG. 3, the oven body 10 according to one or more embodiments of the present invention is a hill-shaped baking oven that includes an upward slope portion 11 at the entrance side, a downward slope portion 13 at the exit side, and a raised-floor portion 12 between the upward slope portion 11 and the downward slope portion 13. From another aspect, as illustrated in the cross-sectional view of FIG. 4A, the oven body 10 is a rectangular baking oven that has a ceiling surface 14, a pair of side wall surfaces 15 and 15 at the right and left, and a floor surface 16. In an alternative embodiment, the oven body 10 may be a flat-type oven. In the side elevational view of FIG. 3, the left side represents a topcoat setting zone at the end of the topcoat paint coating booth and the entrance side of the oven body 10 while the right side represents the exit side of the oven body 10. The vehicle bodies B loaded on the transfer trolleys 50 are conveyed forward from the left to the right of FIG. 3. That is, the vehicle bodies B conveyed in the topcoat paint baking oven 1 according to one or more embodiments of the present invention are conveyed leftward as illustrated in FIG. 2A. In an alternative embodiment, the vehicle bodies B may be conveyed backward.

The floor surface 16 of the raised-floor portion 12 of the oven body 10 has approximately the same height as that of an opening upper end edge of the entrance of the oven body 10 and that of an opening upper end edge of the exit of the oven body 10. Owing to this structure, the hot air supplied into the raised-floor portion 12 can be suppressed from escaping to external of the oven body 10 via the entrance or exit. On the floor surface 16 of the oven body 10, the conveyor 40 is laid along the extending direction of the oven body 10 and parallel to the floor surface 16. The conveyor 40 conveys the transfer trolleys 50 on which the vehicle bodies B are loaded.

The hot air supply device 20 is equipment for supplying the generated hot air into the raised-floor portion 12 of the oven body 10 and, as illustrated in FIG. 4A, comprises an air supply fan 21, air supply filter 22, burner 23, air supply ducts 24, first hot air blowoff ports 25, and second hot air blowoff ports 26. The air supply fan 21 is equipment for supplying the intake air from external into the raised-floor portion 12 of the oven body 10. The air supply filter 22, which is connected to the primary side (air intake side) of the air supply fan 21, filters the intake air from external to separate dust and the like. This allows the air supply fan 21 to suck clean air. The burner 23, which is connected to the secondary side (air discharge side) of the air supply fan 21, heats the air discharged from the air supply fan 21 to a predetermined temperature. This allows the intake air to be supplied as blasts of hot air into the raised-floor portion 12 of the oven body 10.

As illustrated in FIG. 4A, the air supply ducts 24 are arranged along the conveying direction of the vehicle bodies B at the ceiling surface 14 and right and left side wall surfaces 15 and 15 of the oven body 10. The first hot air blowoff ports 25 and the second hot air blowoff ports 26 are each composed of a plurality of rectangular slits (openings) that are formed at predetermined intervals along the extending direction of the air supply ducts 24 arranged in the raised-floor portion 12 of the oven body 10 and wind direction plates that may be provided at the slits as necessary. The first hot air blowoff ports 25 and the second hot air blowoff ports 26 are provided such that respective openings of the slits or respective wind direction plates are directed to a middle part or predetermined sites (the above-described narrow portions N1 and N2) of the oven body 10. This allows the hot air supplied from the air supply fan 21 to be blown to the predetermined sites of the vehicle body B which is conveyed in the oven body 10. In particular, as illustrated in the plan view of FIG. 4B, the first hot air blowoff ports 25 preferably blow the hot air toward the hinges H1 and H2 and the door offset members 70, which will be described later, from obliquely ahead of the vehicle bodies B in their conveying direction.

In the raised-floor portion 12 of the oven body 10 according to one or more embodiments of the present invention, air supply ducts 24 of a temperature rising zone at the entrance side and air supply ducts 24 of a temperature maintaining zone at the exit side may be insulated from each other and the air supply fan 21, air supply filter 22 and burner 23 may be provided for each insulated zone so as to control the temperature and flow rate of the hot air to be supplied to the insulated zones.

The air exhauster 30 is equipment for exhausting the evaporated solvent in the oven body 10 to external of the system, as illustrated in FIG. 4A, and comprises an air exhaust fan 31, air exhaust filter 32, air exhaust ducts 33, and air intake ports 34. The air exhaust fan 31 is a device that sucks the hot air in the oven body 10 and exhausts the hot air to external of the system or circulates the hot air to the primary side of the hot air supply device 20, and functions to remove dusts and the like and regulate the pressure of the hot air in the oven body 10. The air exhaust filter 32 is provided at the secondary side (hot air exhaust side) of the air exhaust fan 31. The hot air is sucked by the air exhaust fan 31 and passes through the air exhaust filter 32 to be exhausted to external of the system or returned to the hot air supply device 20. The air exhaust ducts 33 are provided along the conveying direction of the vehicle body B at the right and left side wall surfaces 15 and 15 of the oven body 10. The air intake ports 34 are composed of slits that are formed at predetermined intervals on the air exhaust ducts 33 disposed in the oven body 10.

As illustrated in FIG. 3, in the upward slope portion 11 at the entrance side of the oven body 10, the conveyor 40 laid in the oven body 10 according to one or more embodiments of the present invention is in a form of an upward slope along the floor surface 16 of the upward slope portion 11. In the downward slope portion 13 at the exit side of the oven body 10, the conveyor 40 is in a form of a downward slope along the floor surface 16 of the downward slope portion 13. In the raised-floor portion 12 of the oven body 10, the conveyor 40 is laid horizontally along the floor surface 16 of the raised-floor portion 12 (the floor surface 16 in the raised-floor portion 12 is disposed horizontally).

As illustrated in FIG. 4A, the second hot air blowoff ports 26 are disposed at upper parts and lower parts of the air supply ducts 24 and 24 of the right and left side wall surfaces 15 and 15 of the oven body 10. The front of each second hot air blowoff port 26 may be configured to include guide parts that are one type of wind direction plates. The second hot air blowoff ports 26 provided at the upper side are opened toward the upstream side and obliquely downward while the second hot air blowoff ports 26 provided at the lower side are opened toward the upstream side and obliquely upward. Consequently, these second hot air blowoff ports 26 are provided such that, when the vehicle body B passes in front of the second hot air blowoff ports 26, the openings are oriented toward the narrow portions N1 and N2 in the vicinities of the hinges H which attach the side doors D to the main shell body B1.

Thus, the second hot air blowoff ports 26 are opened toward the upstream side thereby to allow the hot air to be readily blown toward the vicinities of the hinges H of the vehicle body B which is conveyed in a state in which the side doors D are offset. In addition, since the second hot air blowoff ports 26 are provided at the upper parts and lower parts of the side wall surfaces 15 and 15, the hot air from the second hot air blowoff ports 26 provided at the upper parts is blown mainly to the upper side of the vicinities of the hinges H while the hot air from the second hot air blowoff ports 26 provided at the lower parts is blown mainly to the lower side of the vicinities of the hinges H. The narrow portions N1 and N2 in the vicinities of the hinges H can therefore be uniformly baked.

The first hot air blowoff ports 25 provided at the right and left side wall surfaces 15 and 15 are arranged such that, when the vehicle body B passes in front of the first hot air blowoff ports 25, the openings or wind direction plates are oriented toward the body exterior parts, such as front fenders B11, side doors D and rear fenders B12, of the vehicle body B. In particular, as described above and illustrated in the plan view of FIG. 4B, the first hot air blowoff ports 25 preferably blow the hot air toward the hinges H1 and H2 and the door offset members 70, which will be described later, from obliquely ahead of the vehicle bodies B in their conveying direction.

The first hot air blowoff ports 25 provided at the ceiling surface 14 are arranged such that, when the vehicle body B passes in front of the first hot air blowoff ports 25, the openings or wind direction plates are oriented toward the body exterior parts, such as a hood F, roof B13 and trunk lid T, of the vehicle body B. The first hot air blowoff ports 25 configured as the above blow the hot air to the whole vehicle body B to maintain the temperature of the whole vehicle body B including the body exterior parts.

Figure 5A:
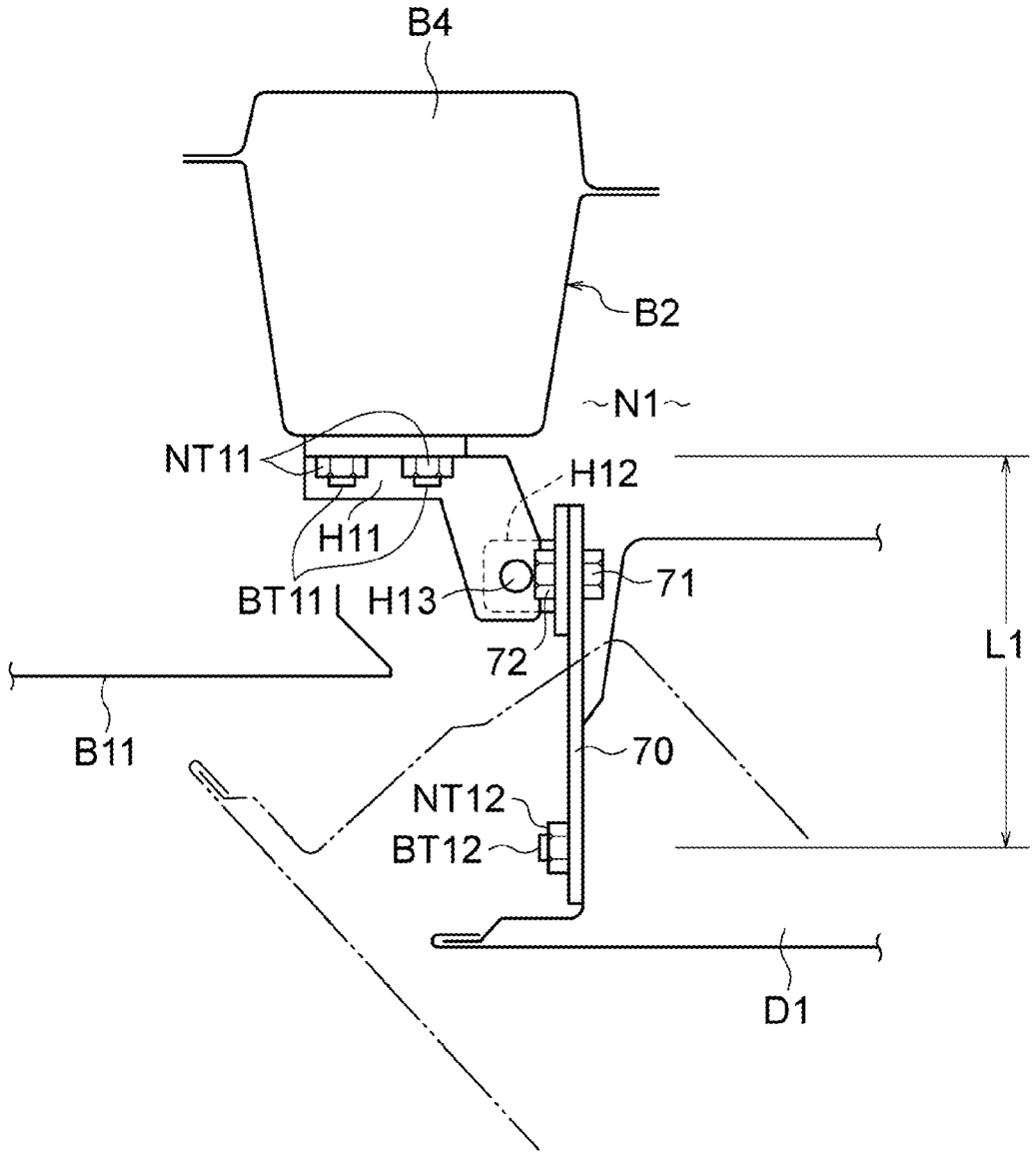
FIG. 5A is a cross-sectional view along line 2D-2D of FIG. 2A in a state in which a door offset member is attached, that is, a cross-sectional view illustrating an example of a narrow portion including a front pillar, front door and hinge.
Figure 5B:
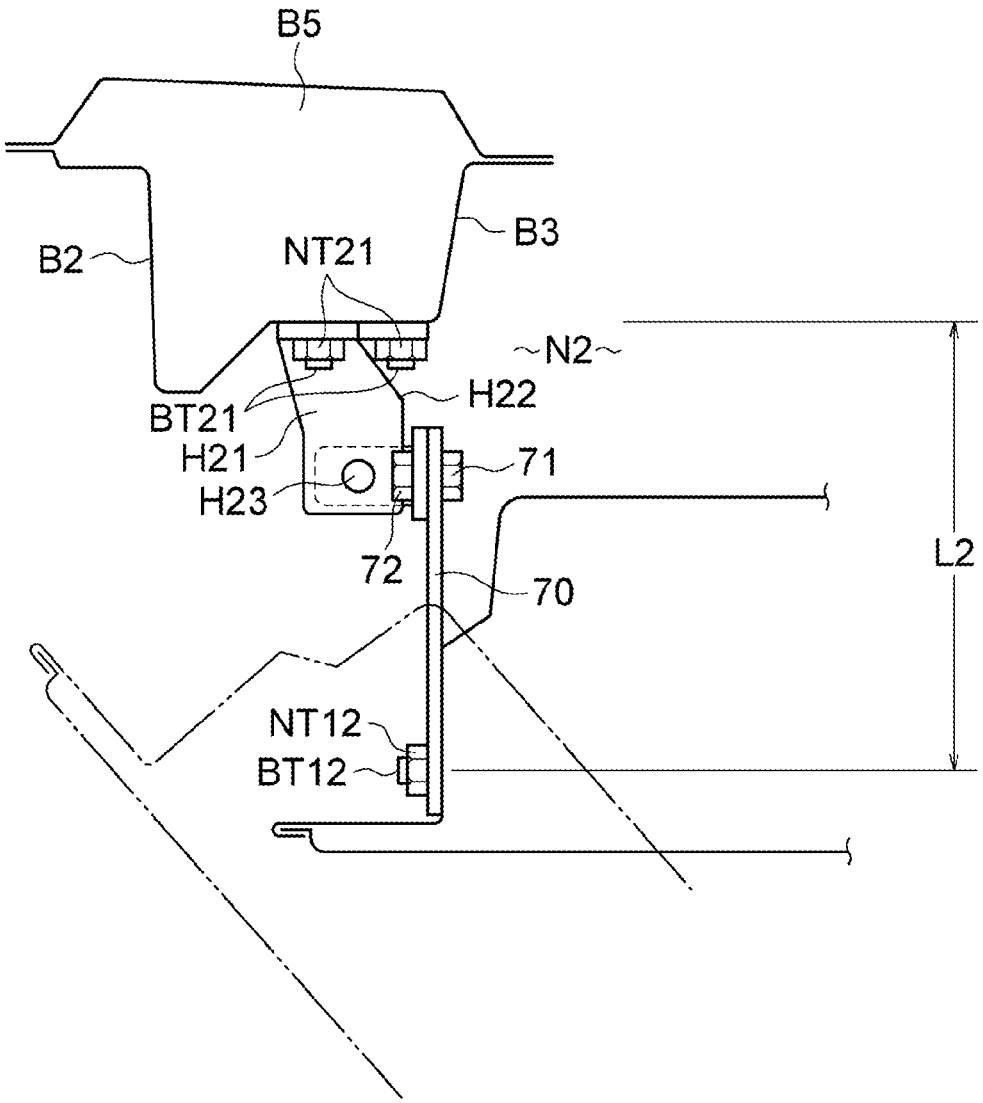
FIG. 5B is a cross-sectional view along line 2E-2E of FIG. 2A in a state in which a door offset member is attached, that is, a cross-sectional view illustrating an example of a narrow portion including a center pillar, rear door and hinge.

Next, the door offset member 70 according to one or more embodiments of the present invention will be described. FIG. 5A is a cross-sectional view along line 2D-2D of FIG. 2A in a state in which the door offset member 70 is attached, that is, a cross-sectional view illustrating an example of the narrow portion N1 including the front pillar B4, front door D1 and hinge H1, FIG. 5B is a cross-sectional view along line 2E-2E of FIG. 2A in a state in which the door offset member 70 is attached, that is, a cross-sectional view illustrating an example of the narrow portion N2 including the center pillar B5, rear door D2 and hinge H2, FIG. 5C is a perspective view illustrating an example of the side panel (including the front pillar B4), front door D1 and hinges H1 in a state in which the door offset members 70 are attached, FIG. 5D is a plan view illustrating the vehicle body B in a state in which the door offset members are attached, and FIG. 5E is a cross-sectional view illustrating a vehicle body in a state in which door offset members are attached.

Figure 5C:
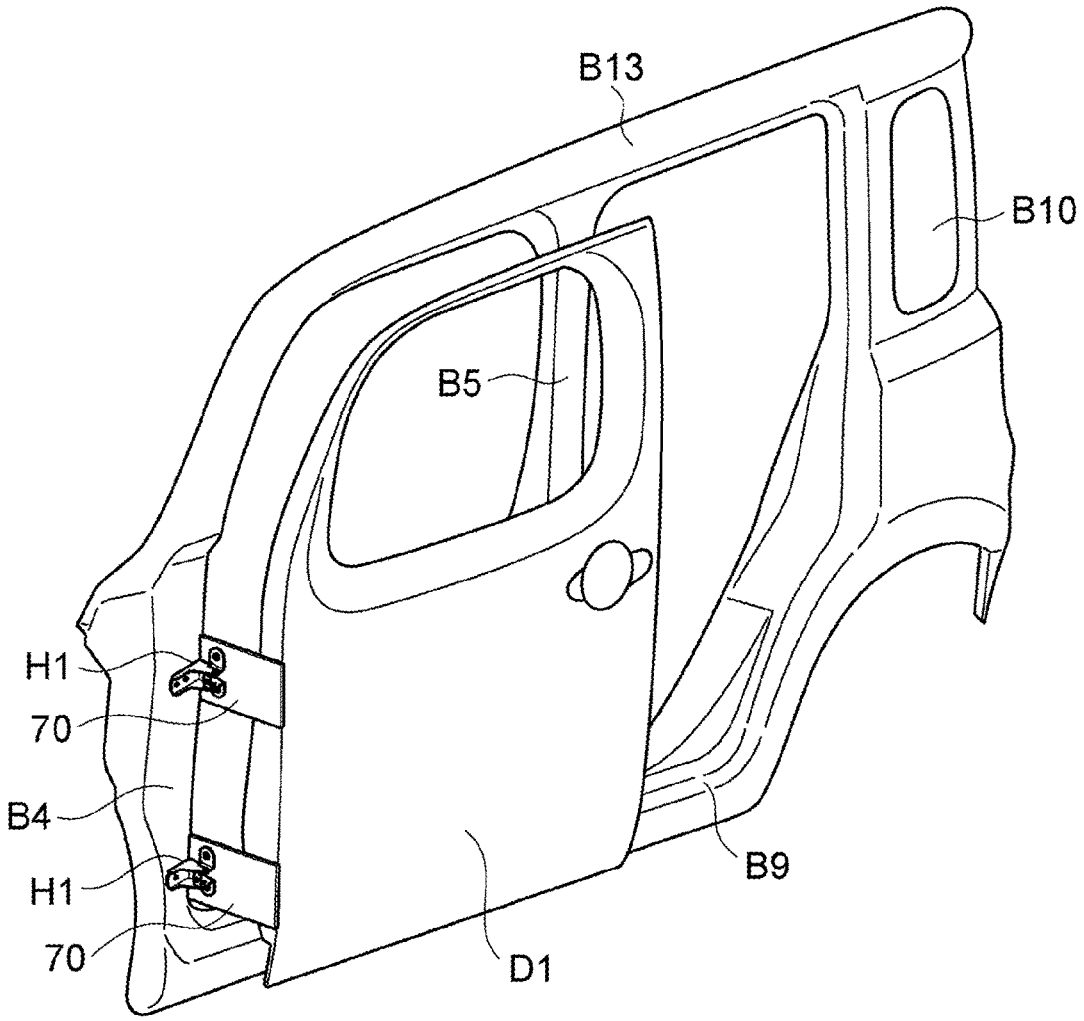
FIG. 5C is a perspective view illustrating an example of a side panel (including a front pillar), front door and hinges in a state in which door offset members are attached.
Figure 5D:
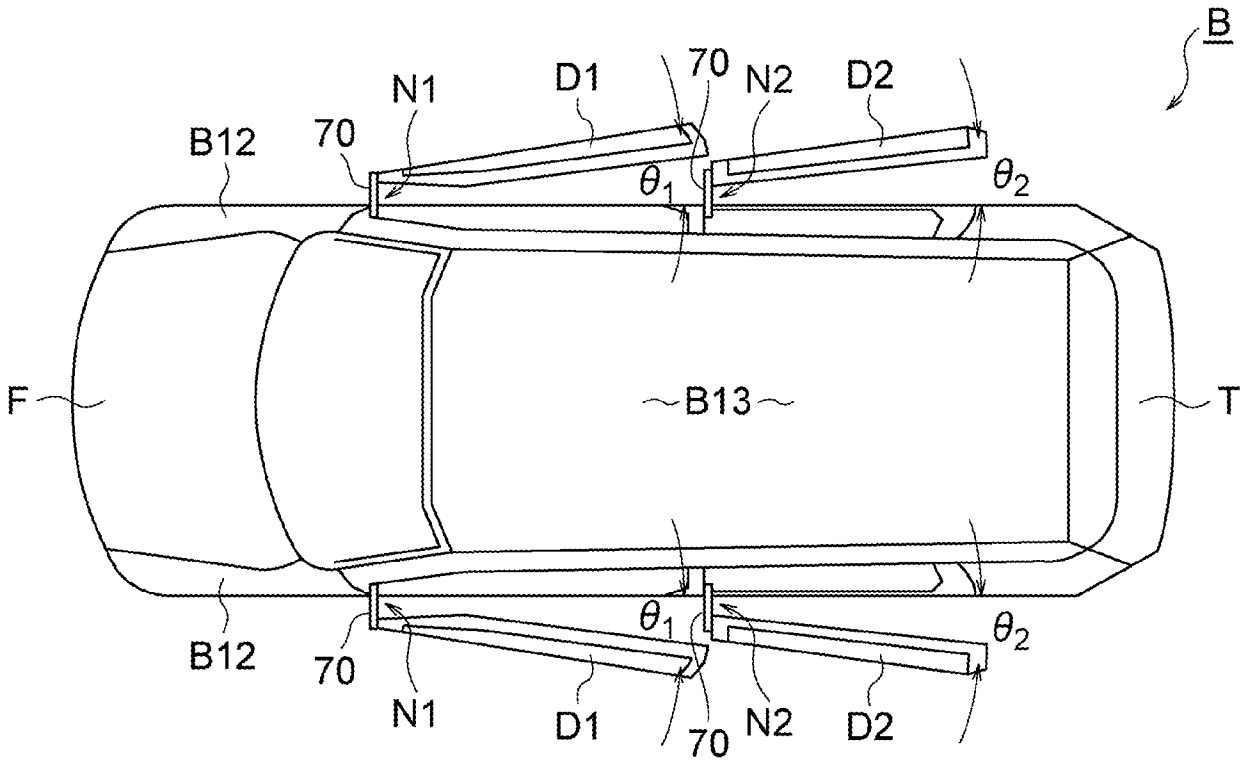
FIG. 5D is a plan view illustrating a vehicle body in a state in which door offset members are attached.
Figure 5E:
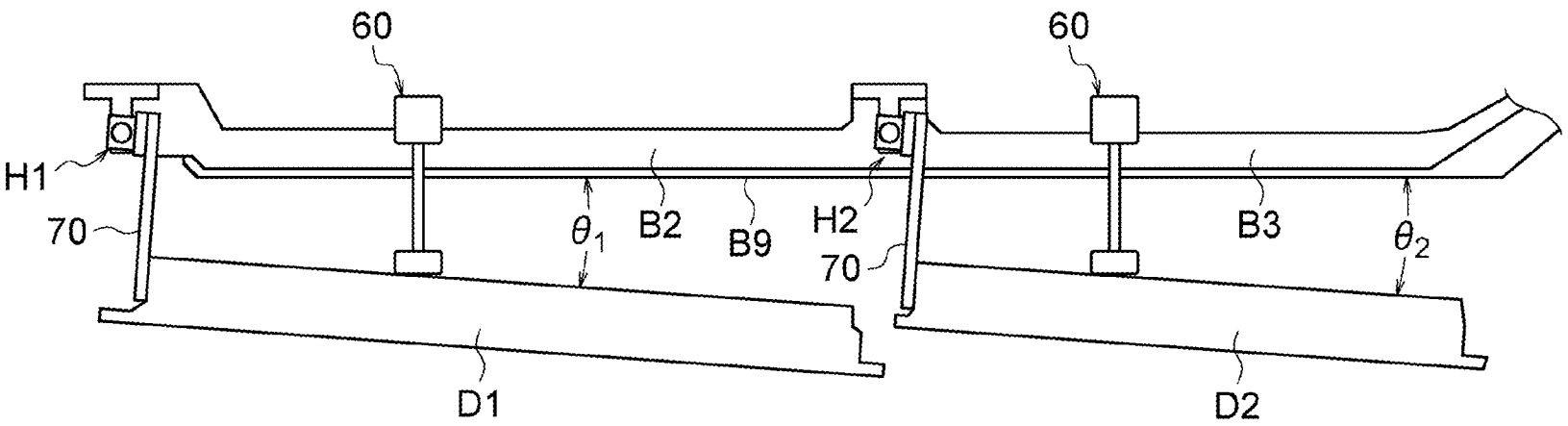
FIG. 5E is a cross-sectional view illustrating a vehicle body in a state in which door offset members are attached.

As illustrated in FIG. 5C, each of the door offset members 70 according to one or more embodiments of the present invention is composed of a rectangular flat plate of conductive material, e.g. a steel plate, and one end portion of the door offset member 70 is formed with through-holes corresponding to the through-holes of the hinge bracket H12 (or H22) of the hinge H1 (or H2). The other end portion of the door offset member 70 is formed with through-holes corresponding to the bolts BT12 (or BT22, in the finished vehicle state, bolts inserted in the through-holes of the hinge bracket H12 (or H22)) at the side of the front door D1 (or D2). With regard to the front door D1, as illustrated in FIG. 5A, one hinge bracket H11 of each hinge H1 is fixed using the bolts BT11, which are welded to the front pillar B4, and the nuts NT11, and the other hinge bracket H12 is fixed to one end portion of the door offset member 70 using bolts 71 and nuts 72. The other end portion of the door offset member 70 is fixed to the bolts BT12, which are welded to the front door D1, using the nuts NT12. With regard to the rear door D2, as illustrated in FIG. 5B, one hinge bracket H21 of each hinge H2 is fixed using the bolts BT21, which are welded to the center pillar B5, and the nuts NT21, and the other hinge bracket H22 is fixed to one end portion of the door offset member 70 using bolts 71 and nuts 72. The other end portion of the door offset member 70 is fixed to the bolts BT22, which are welded to the rear door D2, and the nuts NT22.

The length from one end of the door offset member 70 to the other end can be selected depending on to which extent the doors D1 and D2 are offset to reduce the spaces of the narrow portions N1 and N2. That is, as the length from one end of the door offset member 70 to the other end increases, the spaces of the narrow portions N1 and N2 around the hinges H1 and H2 of doors D1 and D2 increase, which may not narrow portions anymore. However, if the offset amount is unduly increased, the body width of the vehicle body B will also increase, so that the width dimensions of various equipment provided in the coating process line PL may have to be increased. In addition, if the offset amount is unduly increased, the distance from a paint gun will be different only at portions of the side doors D in the intermediate paint coating process and the topcoat paint coating process and the painting workability may possibly deteriorate. Thus, the offset amount when using the door offset members 70 according to one or more embodiments of the present invention is preferably a minimum distance with which the baking condition for the narrow portions N1 and N2 is satisfied.

When the door offset members 70 according to one or more embodiments of the present invention are attached between the hinges H and the side doors D, each front door D1 is located such that, as illustrated in FIG. 5A, a distance L1 between the bolts BT11 as hinge fastening parts at the side of the main shell body B1 and the bolts BT12 as hinge fastening parts of the front door D1 is longer than a distance L1 in the finished vehicle state illustrated in FIG. 2D. Similarly, each rear door D2 is located such that a distance L2 between the bolts BT21 as hinge fastening parts at the side of the main shell body B1 and the bolts BT22 as hinge fastening parts of the rear door D2 is longer than a distance L2 in the finished vehicle state illustrated in FIG. 2E.

In the case of a four-door sedan type of the vehicle body B illustrated in FIG. 5D, when the door offset members 70 according to one or more embodiments of the present invention are attached between the hinges H and the side doors D, the rear edge of each front door D1 and the front edge of corresponding rear door D2 come close to each other thereby to cause another narrow space there. As illustrated in FIG. 5D and FIG. 5E, therefore, the front doors D1 and the rear doors D2 are locked in a state of being slightly opened. Opening degrees θ1 and θ2 of the front doors D1 and rear doors D2 differ depending also on the lengths of the frond doors D1 and rear doors D2, but are preferably set to, for example, 5° to 30° so that a space of about 100 to 300 mm is ensured between the above-described rear edge of each front door D1 and front edge of corresponding rear door D2.

Figure 5F:
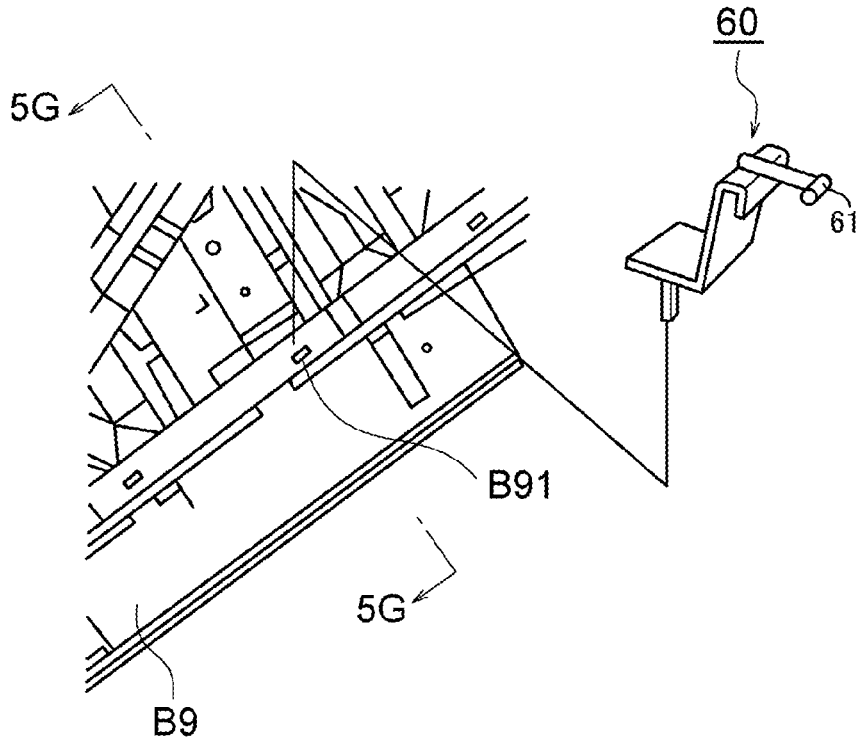
FIG. 5F is a perspective view illustrating an example of a door stopper jig for use in a topcoat paint baking oven according to one or more embodiments of the present invention.
Figure 5G:
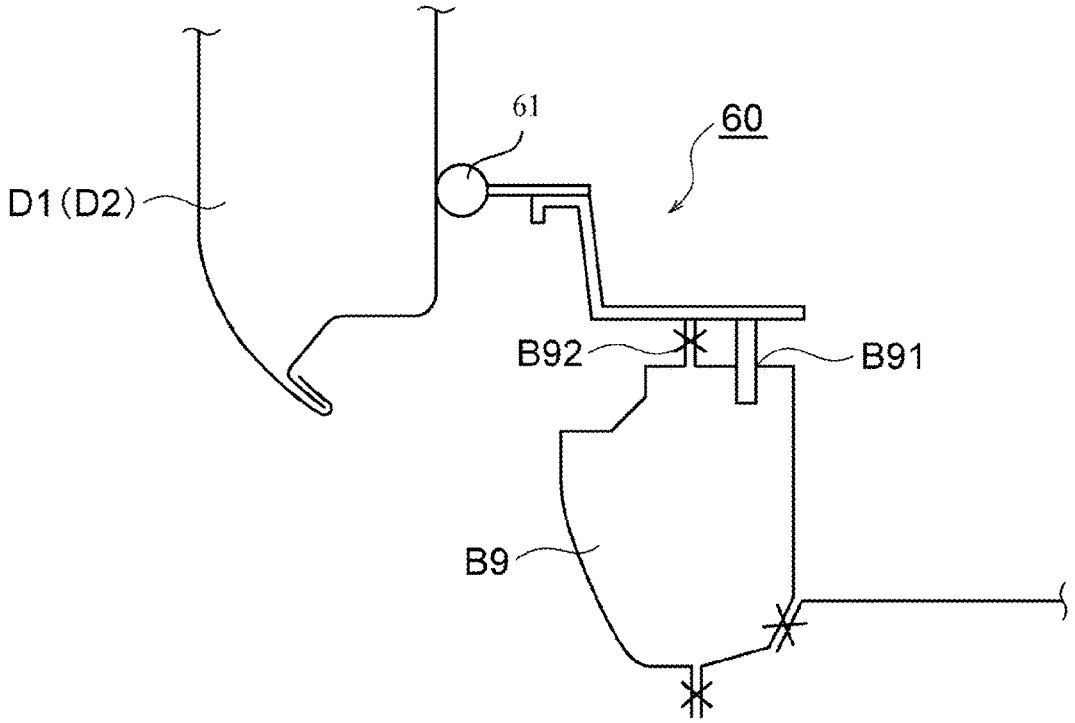
FIG. 5G is a cross-sectional view along line 5G-5G of FIG. 5F, that is, a cross-sectional view illustrating an attaching state of the door stopper jig.

To lock up such opening degrees of the side doors D1 and D2, in a process at least before the vehicle body B is carried into the topcoat paint baking oven 1, door stopper jigs 60 as illustrated in FIG. 5F and FIG. 5G are preferably attached to the vehicle body B. If the side doors D1 and D2 are closed to the closing limit, the door inner panels or door sashes will hit against the door opening parts B2 and B3 of the main shell body B1 to deform or damage some of them. Attaching the door stopper jigs 60 can therefore prevent such deformation and damage. The door stopper jigs 60 illustrated in FIG. 5F and FIG. 5G are each a jig that is attached to a hole B91 and flange B92 of the side sill B9 and acts to come into contact with a site of the door inner panel, which is to be hidden by an outfitting part, so that the side door D is not closed to the closing limit. The door stopper jigs 60 according to one or more embodiments of the present invention are each provided with an abutting part 61 composed of a magnet material that absorbs the door inner panel of a steel sheet, and the magnetic force of the abutting part 61 maintains the side door D in a closed state.

Figure 6A:
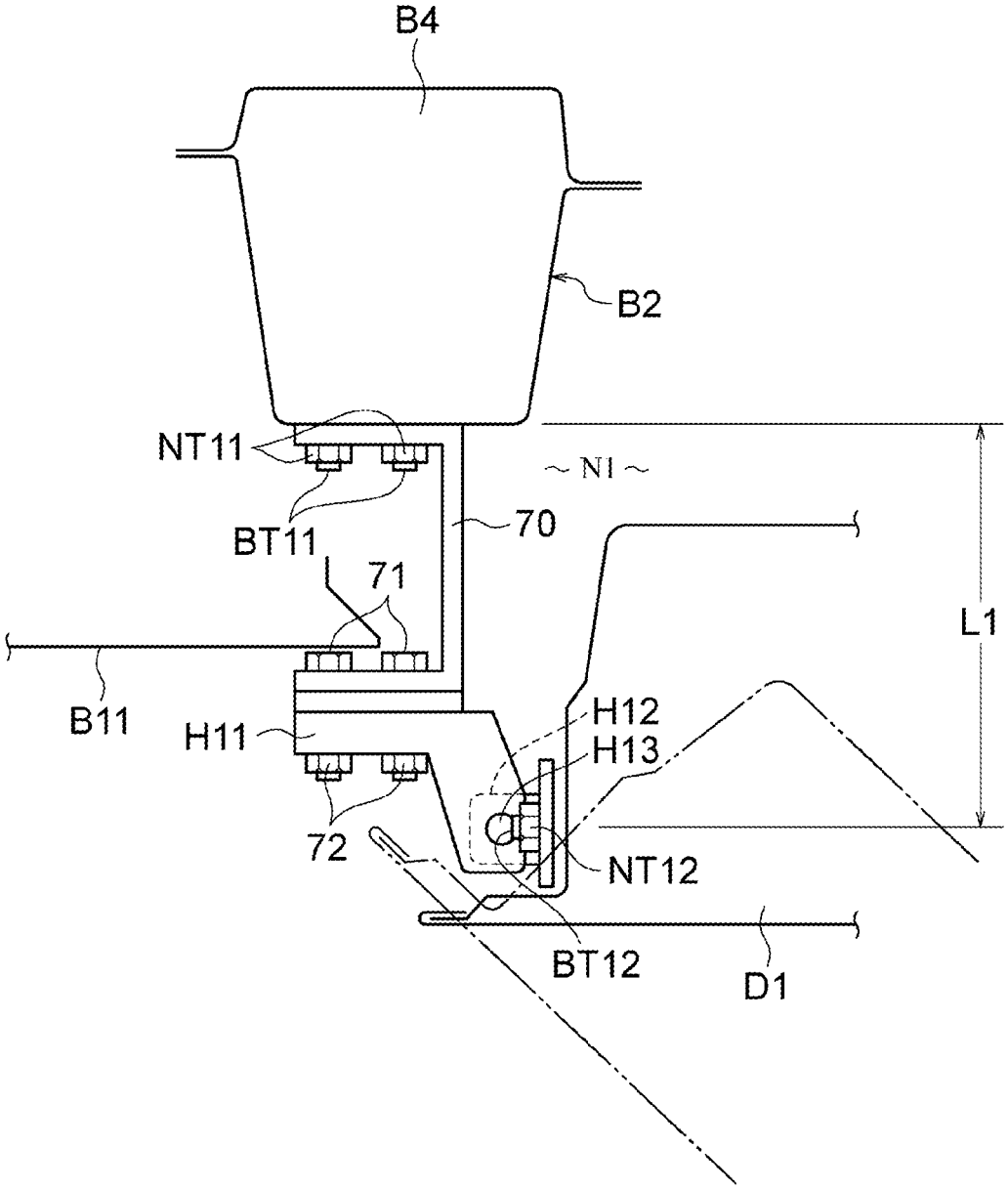
FIG. 6A is a cross-sectional view along line 2D-2D of FIG. 2A in a state in which a door offset member according to another embodiment is attached, that is, a cross-sectional view illustrating an example of a narrow portion including a front pillar, front door and hinge.
Figure 6B:
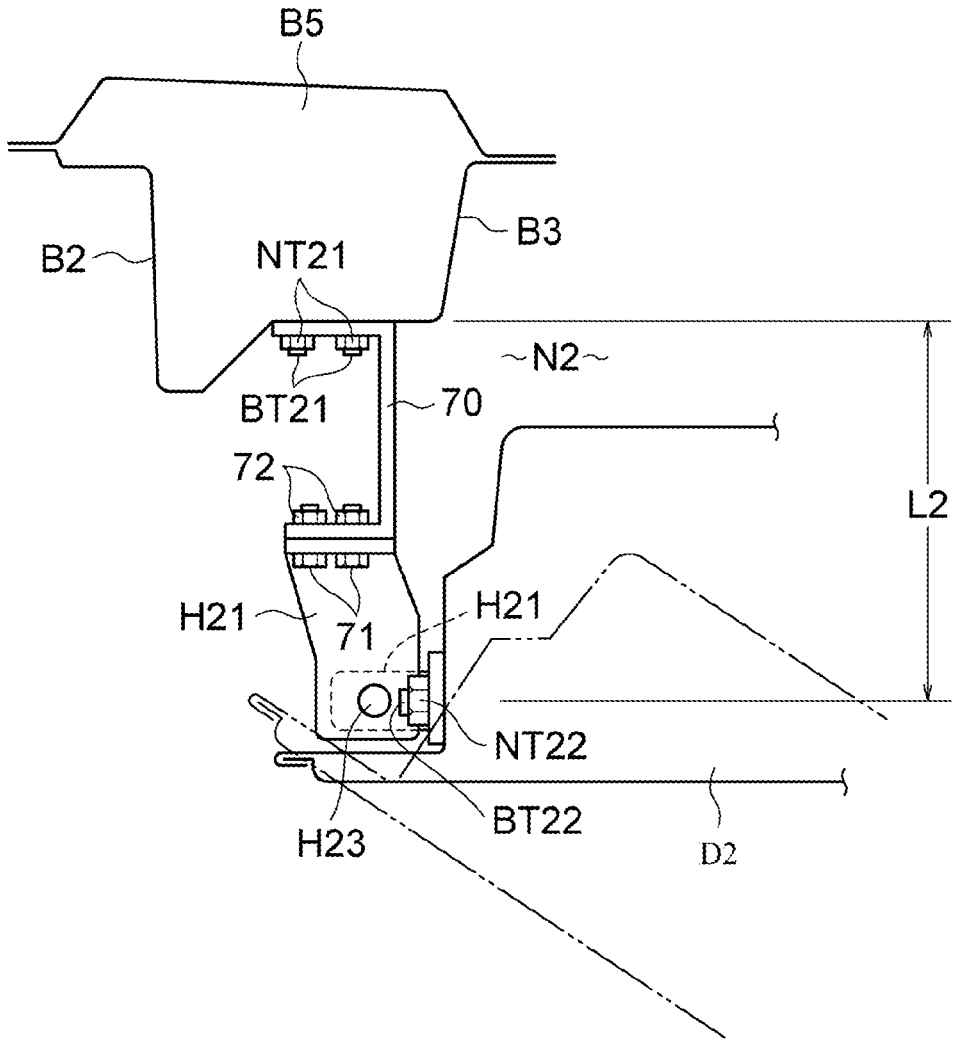
FIG. 6B is a cross-sectional view along line 2E-2E of FIG. 2A in a state in which a door offset member according to another embodiment is attached, that is, a cross-sectional view illustrating an example of a narrow portion including a center pillar, rear door and hinge.

In the door offset members 70 illustrated in FIG. 5A and FIG. 5B, each hinge H1 is attached to the front pillar B4 and the door offset member 70 is attached between the hinge bracket H12 of the hinge H1 and the front door D1. In an alternative embodiment, each hinge H1 is attached to the front door D1 and the door offset member 70 is attached between the hinge bracket H11 of the hinge H1 and the front pillar B4. FIG. 6A is a cross-sectional view along line 2D-2D of FIG. 2A in a state in which the door offset member 70 according to another embodiment is attached, that is, a cross-sectional view illustrating an example of the narrow portion N1 including the front pillar B4, front door D1 and hinge H1 and FIG. 6B is a cross-sectional view along line 2E-2E of FIG. 2A in a state in which the door offset member 70 according to another embodiment is attached, that is, a cross-sectional view illustrating an example of the narrow portion N2 including the center pillar B5, rear door D2 and hinge H2. The door offset members 70 in this case are each a steel plate of which both end portions are folded, rather than a rectangular flat steel plate, but have the same actions and effects as those of the door offset members 70 illustrated in FIG. 5A and FIG. 5B.

As illustrated in FIG. 6A and FIG. 6B, each of the door offset members 70 according to one or more embodiments of the present invention is formed such that both end portions of a rectangular flat plate of conductive material, e.g. a steel plate, are folded to the same direction, and a flange of one end portion of the door offset member 70 is formed with through-holes corresponding to the bolts BT12 (or BT22, in the finished vehicle state, bolts inserted in the through-holes of the hinge bracket H12 (or H22)) at the side of the front door D1 (or D2). A flange of the other end portion of the door offset member 70 is formed with through-holes corresponding to the through-holes of the hinge bracket H12 (or H22) of the hinge H1 (or H2). With regard to the front door D1, as illustrated in FIG. 6A, the flange of one end portion of the door offset member 70 is fixed to the bolts BT11, which are welded to the front pillar B4, using the nuts NT11, and the flange of the other end portion of the door offset member 70 is fixed to one hinge bracket H11 of the hinge H1 using bolts 71 and nuts 72. The other hinge bracket H12 of the hinge H1 is fixed to the bolts BT12, which are welded to the front door D1, using the nuts NT12.

With regard to the rear door D2, as illustrated in FIG. 6B, the flange of one end portion of the door offset member 70 is fixed to the bolts BT21, which are welded to the center pillar B5, using the nuts NT21, and the flange of the other end portion of the door offset member 70 is fixed to one hinge bracket H21 of the hinge H2 using bolts 71 and nuts 72. The other hinge bracket H22 of the hinge H2 is fixed to the bolts BT22, which are welded to the rear door D2, using the nuts NT22.

The process for attaching the door offset members 70 according to one or more embodiments of the present invention has to precede at least the paint baking device. For example, in the coating process line PL illustrated in FIG. 1A, the process preferably precedes the topcoat paint baking process P52 or the intermediate paint baking process P32. In the coating process line PL illustrated in FIG. 1B, the process preferably precedes the intermediate paint and topcoat paint baking process P72. Examples of such preferred embodiments include an embodiment in which the door offset members 70 are attached in a process for attaching hinges in the shell body assembly process line WL and the vehicle bodies B are conveyed from the under coating process P1 to the final inspection process P6 in a state in which the side doors D are offset and slightly opened as illustrated in FIG. 5D. In this case, the door offset members 70 are removed in the final inspection process P6 or in the vehicle component assembly process line ASL and the hinges H are attached to the originally designed attaching positions for the hinges H.

Other examples of the process for attaching the door offset members 70 in the coating process line PL illustrated in FIG. 1A include a process X1 between the under coating process P1 and the sealing process P2, a process X2 between the sealing process P2 and the intermediate coating process P3, and a process X3 between the wet sanding drying process P41 (if this process is omitted, the intermediate coating process P3) and the topcoat paint coating process P51. In the coating process line PL illustrated in FIG. 1B, such examples include a process X1 between the under coating process P1 and the sealing process P2 and a process X2 between the sealing process P2 and the intermediate and topcoat coating process P7.

The process for attaching the door offset members 70 may be appropriately selected in accordance with each spec of the coating process line PL, shell body assembly process line WL, and vehicle component assembly process line ASL. When the door offset members 70 are attached in the process X3 of FIG. 1A between the wet sanding drying process P41 (if this process is omitted, the intermediate coating process P3) and the topcoat paint coating process P51 or in the process X2 of FIG. 1B between the sealing process P2 and the intermediate and topcoat coating process P7, an advantage is obtained in that the side doors D1 and D2 are not required to be held in the state of unbaked coating film, as compared with a case of attaching the door offset members 70 in a process between the topcoat paint coating process P51 and the topcoat paint baking process P52 illustrated in FIG. 1A. When the door offset members 70 are attached in the process X1 of FIG. 1A and FIG. 1B between the under coating process P1 and the sealing process P2, an advantage is obtained in that the workability in applying a sealing material to door hemming parts in the sealing process is improved, in addition to the advantage in the above case. When the door offset members 70 are attached in the shell body assembly process line WL, an advantage is obtained in that the work of removing the hinges H once attached to regular positions is omitted, in addition to the advantages in the above cases. On the other hand, the process for removing the door offset members 70 and attaching the hinges H to the regular positions may be performed in any of the final inspection process and the vehicle component assembly process line ASL, but when the door offset members 70 are removed in the vehicle component assembly process line ASL, an advantage is obtained in that the workability in assembling relevant components into around the narrow portions N1 and N2 is improved because the spaces between the side doors D and the main shell body B1 remain large until the removal of the door offset members 70.

Figure 7:
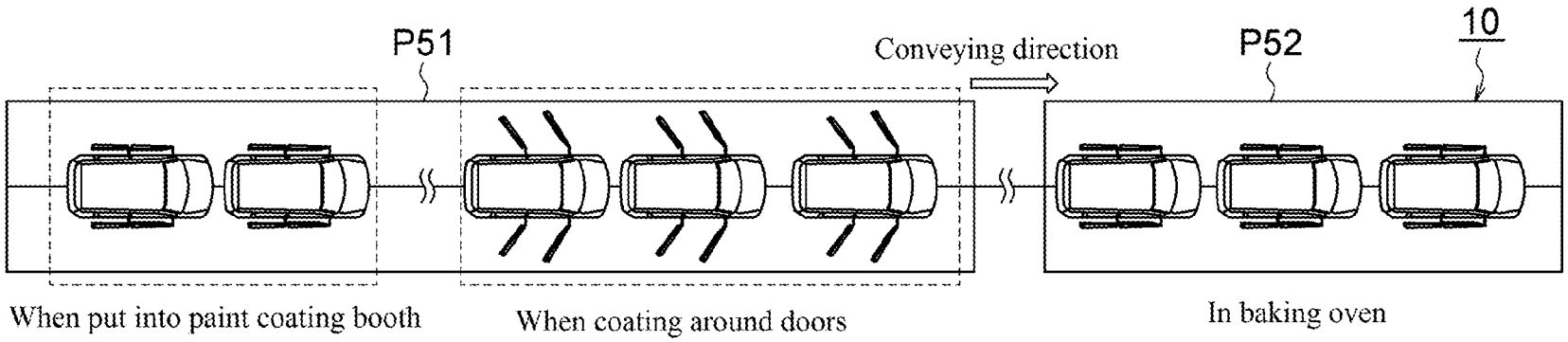
FIG. 7 is a plan view illustrating an opened state and closed state of side doors in a topcoat paint coating booth and a topcoat paint baking oven according to one or more embodiments of the present invention.

FIG. 7 is a plan view illustrating an opened state and closed state of the side doors D1 and D2 in the topcoat paint coating booth (topcoat paint coating process P51) and topcoat paint baking oven 1 (topcoat paint baking process P52) according to one or more embodiments of the present invention. In this case, the door offset members 70 are attached in any of the shell body assembly process line WL, process X1, process X2, or process X3 illustrated in FIG. 1A and FIG. 1B. As illustrated in FIG. 7, in the paint coating booth, the side doors D1 and D2 are closed in the process for coating the exterior of the vehicle bodies B and opened in the process for coating around the door inners of the side doors D1 and D2. When the vehicle bodies B are carried into the topcoat paint baking oven 1, the side doors D1 and D2 are locked in a state of being slightly opened as described above.

The topcoat paint baking method and door offset members 70 according to one or more embodiments of the present invention have the following actions and effects.

In most cases, a vehicle body B is configured to include a site that is easily exposed to hot wind and a site that is not easily exposed to hot wind. For example, even when vehicle bodies are conveyed into the topcoat paint baking oven 1 in a state of closing the side doors D, the hot air is less likely to go around into the narrow portions N1 and N2 in the vicinities of the hinges H1 and H2 of the side doors D. In contrast, the body exterior parts such as outer panels of the side doors D can be directly blown with the hot air and thus easily heated. For these reasons, if the setting condition for the hot air temperature, time of passage and the like in the topcoat paint baking oven 1 is adapted to the narrow portions N1 and N2 which cannot be easily heated, not only the body exterior parts which can be easily heated will be beyond the quality assurance standard to a large degree to needlessly consume energy, but also over-baking may possibly occur in some cases to rather deteriorate the coating quality. If, on the other hand, the setting condition for the hot air temperature, time of passage and the like in the topcoat paint baking oven 1 is adapted to the body exterior parts which can be easily heated, the baking condition for the coating films of the narrow portions N1 and N2 will not satisfy the quality assurance standard to cause so-called poor baking, and the deterioration in the coating film properties and delamination of the coating film may possibly occur.

(1) According to one or more embodiments of the present invention, the door offset members 70 are used to offset the side doors D from the main shell body B1 and, in this state, the vehicle bodies B are exposed to the hot air atmosphere thereby to allow the baking condition to be uniform across the whole area of the coating film of each vehicle body B including the narrow portions N1 and N2, and not only the coating film quality is improved but also energy saving can be achieved.

(2) When the front doors D1 and the rear doors D2 are locked in a state of being slightly opened as illustrated in FIG. 5D, FIG. 5E, FIG. 5A and FIG. 6B, the rear edge of each front door D1 and the front edge of corresponding rear door D2 can be prevented from coming close to each other to cause another narrow space there.

(3) As illustrated in FIG. 4B, the hot air is blown toward the hinges H1 and H2 and the door offset members 70 from obliquely ahead of the vehicle bodies B in their conveying direction. The hot air can thereby be sent locally to the narrow portions N1 and N2 which are most difficult in each vehicle body B to satisfy the baking condition.

DESCRIPTION OF REFERENCE NUMERALS

| | | | | | |
|---|---|---|---|---|---|
| PRL | Press-forming process line | | | | |
| WL | Shell body assembly process line (Welding process line) | | | | |
| ASL | Vehicle component assembly process line (Outfitting process line) | | | | |
| PL | Coating process line | | | | |
| | P1 | Under coating process (Electrodeposition coating process) | | | |
| | | P11 | Pretreatment process for electrodeposition coat | | |
| | | P12 | Electrodeposition paint coating process | | |
| | | P13 | Electrodeposition paint baking process | | |
| | P2 | Sealing process | | | |
| | P3 | Intermediate coating process | | | |
| | | P31 | Intermediate paint coating process | | |
| | | P32 | Intermediate paint baking process | | |
| | P4 | Wet sanding process | | | |
| | | P41 | Wet sanding drying process | | |
| | P5 | Topcoat process | | | |
| | | P51 | Topcoat paint coating process | | |
| | | P52 | Topcoat paint baking process | | |
| | P6 | Final inspection process | | | |
| | P7 | Intermediate and topcoat coating process | | | |
| | | P71 | Intermediate paint and topcoat paint coating process | | |
| | | P72 | Intermediate paint and topcoat paint baking process | | |
| D/L | Drop-lifter | | | | |
| B | Shell body (Object to be coated) | | | | |
| | B1 | Main shell body | | | |
| | | B2 | Front door opening part | | |
| | | B3 | Rear door opening part | | |
| | | B4 | Front pillar | | |
| | | B5 | Center pillar | | |
| | | B6 | Front under body | | |
| | | B7 | Rear under body | | |
| | | B8 | Roof side rail | | |
| | | B9 | Side sill | | |
| | | B10 | Rear pillar | | |
| | | B11 | Front fender | | |
| | | B12 | Rear fender | | |
| | | B13 | Roof | | |
| | F | Hood (Bonnet) | | | |
| | T | Trunk lid | | | |
| | D | Side door | | | |
| | | D1 | Front door | | |
| | | | H1 (H) | | Hinge |
| | | | | H11, H12 | Hinge bracket |
| | | | | H13 | Hinge pin |
| | | D2 | Rear door | | |
| | | | H2 (H) | | Hinge |
| | | | | H21, H22 | Hinge bracket |
| | | | | H23 | Hinge pin |
| | BT11, BT12, BT21, BT22 | | Bolt | | |
| | NT11, NT12, NT21, NT22 | | Nut | | |
| N1, N2 | Narrow portion | | | | |
| 1 | Topcoat paint baking oven | | | | |
| | 10 | Oven body | | | |
| | | 11 | Upward slope portion at an entrance side | | |
| | | 12 | Raised-floor portion | | |
| | | 13 | Downward slope portion at an exit side | | |
| | | 14 | Ceiling surface | | |
| | | 15 | Side wall surface | | |
| | | 16 | Floor surface | | |
| | 20 | Hot air supply device | | | |
| | | 21 | Air supply fan | | |
| | | 22 | Air supply filter | | |
| | | 23 | Burner | | |
| | | 24 | Air supply duct | | |
| | | 25 | First hot air blowoff port | | |
| | | 26 | Second hot air blowoff port | | |

-continued

| | | |
|---|---|---|
| 30 | Air exhauster | |
| | 31 | Air exhaust fan |
| | 32 | Air exhaust filter |
| | 33 | Air exhaust duct |
| | 34 | Air intake port |
| 40 | Conveyor | |
| | 41 | Rail |
| 50 | Transfer trolley | |
| | 51 | Base |
| | 52 | Front attachment |
| | 53 | Rear attachment |
| | 54 | Wheel |
| 60 | Door stopper jig | |
| | 61 | Abutting part |
| 70 | Door offset member | |
| | 71 | Bolt |
| | 72 | Nut |

The invention claimed is:

1. A paint baking method for a vehicle body including a main shell body and a side door, wherein a hinge is attached to a hinge fastening part of the side door and a hinge fastening part of the main shell body in a finished vehicle state, the paint baking method comprising:

attaching a door offset member to the hinge and one of either the hinge fastening part of the main shell body or the hinge fastening part of the side door so that a distance between the hinge fastening part of the main shell body and the hinge fastening part of the side door in a state in which the door offset member is attached is longer than a distance between the hinge fastening part of the main shell body and the hinge fastening part of the side door in the finished vehicle state; and while in the state in which the door offset member is attached, conveying the vehicle body while exposing the vehicle body to a hot air atmosphere to bake a wet coating film applied to the vehicle body.

2. The paint baking method according to claim 1, wherein the vehicle body is exposed to the hot air atmosphere in a state in which the side door is opened by 5° to 30° with respect to a longitudinal direction of the vehicle body.

3. The paint baking method according to claim 1, wherein exposing the vehicle body to the hot air atmosphere includes blowing hot air toward the hinge and the door offset member from obliquely ahead of the vehicle body in its conveying direction.

4. The paint baking method according to claim 1, wherein the door offset member is attached in a shell body assembly process line and removed in a vehicle component assembly process line.

5. The paint baking method according to claim 1, further comprising:

attaching a door stopper to the main shell body at least before a topcoat paint coating process, wherein the door stopper has an abutting part composed of a magnet material that absorbs a door inner panel of a steel sheet, and a magnetic force of the abutting part maintains the side door in a closed state.

6. The paint baking method according to claim 1, wherein the hinge is connected to the other of either the hinge fastening part of the main shell body or the hinge fastening part of the side door.

7. The paint baking method according to claim 1, wherein the hinge is connected to the other of either the hinge fastening part of the main shell body or the hinge fastening part of the side door in both the finished vehicle state and the state in which the door offset member is attached.

8. The paint baking method according to claim 1, wherein the side door is pivotable in relation to the main shell body in the state in which the door offset member is attached.

9. The paint baking method according to claim 1, wherein the side door is pivotable in relation to the main shell body in both the finished vehicle state and the state in which the door offset member is attached.

10. The paint baking method according to claim 1, wherein the door offset member and the side door are pivotable in relation to the main shell body in the state in which the door offset member is attached.

11. The paint baking method according to claim 10, wherein the door offset member and the side door pivot in unison in relation to the main shell body in the state in which the door offset member is attached.

12. The paint baking method according to claim 1, wherein the door offset member has opposing and substantially parallel first and second planar surfaces, wherein the hinge is adjacent to the first planar surface, and the hinge fastening part of the side door is adjacent to the second planar surface.

13. The paint baking method according to claim 1, further comprising:

removing the door offset member from the one of either the hinge fastening part of the main shell body or the hinge fastening part of the side door.

14. The paint baking method according to claim 13, wherein the hinge remains attached to the other of either the hinge fastening part of the main shell body or the hinge fastening part of the side door while the door offset member is removed.

15. The paint baking method according to claim 1, wherein the hinge is configured such that first and second hinge members are coupled with each other in a rotatable manner via a hinge pin, wherein in the finished vehicle state of the vehicle body, the first hinge member is fixed to the hinge fastening part of the main shell body, and the second hinge member is fixed to the hinge fastening part of the side door, wherein in the state in which the door offset member is attached, a first end of the door offset member is fixed to the hinge fastening part of the main shell body, a second end of the door offset member is fixed to the first hinge member, and the second hinge member is fixed to the hinge fastening part of the side door, or the first end of the door offset member is fixed to the hinge fastening part of the side door, the second end of the door offset member is fixed to the second hinge member, and the first hinge member is fixed to the hinge fastening part of the main shell body.

16. A paint baking method for a vehicle body including a main shell body and a side door, the paint baking method comprising:

attaching a door offset member to a hinge and a hinge fastening part of the side door so that a distance between a hinge fastening part of the main shell body and the hinge fastening part of the side door in a state in which the door offset member is attached is longer than a distance between the hinge fastening part of the main shell body and the hinge fastening part of the side door in a finished vehicle state; and while in the state in which the door offset member is attached, conveying the vehicle body while exposing the vehicle body to a hot air atmosphere to bake a wet coating film applied to the vehicle body.

17. The paint baking method according to claim 16, further comprising:

removing the door offset member from the hinge and the hinge fastening part of the side door, wherein the hinge remains fixed to the hinge fastening part of the main shell body after the door offset member is removed.

18. The paint baking method according to claim 16, wherein the door offset member and the side door are pivotable in relation to the main shell body in the state in which the door offset member is attached.

19. The paint baking method according to claim 16, wherein the side door is pivotable in relation to the main shell body in both the finished vehicle state and the state in which the door offset member is attached.

* * * * *